US012635771B2

(12) United States Patent
Chayahara

(10) Patent No.: US 12,635,771 B2
(45) Date of Patent: May 26, 2026

(54) SLIDER FOR SLIDE FASTENER

(71) Applicant: YKK Corporation, Tokyo (JP)

(72) Inventor: Yuki Chayahara, Kurobe (JP)

(73) Assignee: YKK Corporation, Tokyo (JP)

( * ) Notice: Subject to any disclaimer, the term of this patent is extended or adjusted under 35 U.S.C. 154(b) by 49 days.

(21) Appl. No.: 18/876,804

(22) PCT Filed: Jun. 22, 2022

(86) PCT No.: PCT/JP2022/024973
§ 371 (c)(1),
(2) Date: Dec. 19, 2024

(87) PCT Pub. No.: WO2023/248395
PCT Pub. Date: Dec. 28, 2023

(65) Prior Publication Data

US 2025/0374999 A1 Dec. 11, 2025

(51) Int. Cl.
*A44B 19/26* (2006.01)
*A44B 19/30* (2006.01)

(52) U.S. Cl.
CPC ..... *A44B 19/303* (2013.01); *A44B 19/262* (2013.01); *A44B 19/305* (2013.01)

(58) Field of Classification Search
CPC ... A44B 19/303; A44B 19/262; A44B 19/305; A44B 19/26; A44B 19/28;
(Continued)

(56) References Cited

U.S. PATENT DOCUMENTS 2,681,490 A * 6/1954 Okolowicz ..... A44B 19/28 24/419
2,890,512 A * 6/1959 Stilwell ..... A44B 19/28 24/419
(Continued)

FOREIGN PATENT DOCUMENTS

FR 1600416 A 7/1970
JP 5828960 B2 10/2015
(Continued)

OTHER PUBLICATIONS

International Preliminary Report on Patentability, PCT Patent Application No. PCT/JP2022/024973, Dec. 18, 2024, 7 pages.
(Continued)

*Primary Examiner* — Jack W Lavinder
(74) *Attorney, Agent, or Firm* — Kilpatrick Townsend Stockton LLP

(57) ABSTRACT

A slide fastener slider includes: a lower member; an upper member; a cover; and a pull tab. The lower member includes a lower blade, a guide column, an upper plate portion, and an attachment column. The upper member includes a flat plate portion, an opening portion, and a placement portion. The cover includes, at an end portion thereof in the front and rear direction, an engaging portion engaged with an engaged portion provided on the attachment column. A shaft portion provided at one end of the pull tab is disposed in a space formed between the upper plate portion and the cover. The placement portion is sandwiched between the engaging portion of the cover and the upper plate portion by attaching the cover to the attachment column by engaging the engaging portion of the cover with the engaged portion of the attachment column.

9 Claims, 19 Drawing Sheets

(58) Field of Classification Search
CPC ..... Y10T 24/2588; Y10T 24/2561; Y10T 24/2563; Y10T 24/2568
See application file for complete search history.

(56) References Cited

U.S. PATENT DOCUMENTS

| | | | | |
|---|---|---|---|---|
| 3,574,247 | A * | 4/1971 | Jakob | A44B 19/26 24/430 |
| 8,356,391 | B2 * | 1/2013 | Iwase | A44B 19/306 24/429 |
| 9,545,134 | B1 | 1/2017 | Tan | |
| 2002/0088097 | A1 * | 7/2002 | Lin | A44B 19/26 24/433 |
| 2004/0231115 | A1 * | 11/2004 | Keyaki | A44B 19/26 24/429 |
| 2013/0025092 | A1 * | 1/2013 | Ozawa | A44B 19/26 24/429 |
| 2015/0157097 | A1 | 6/2015 | Matsushima et al. | |
| 2015/0189954 | A1 | 7/2015 | Yoneoka et al. | |
| 2017/0000221 | A1 | 1/2017 | Tang | |
| 2018/0070685 | A1 | 3/2018 | Tang et al. | |
| 2019/0231035 | A1 | 8/2019 | Lee | |

FOREIGN PATENT DOCUMENTS

| | | | |
|---|---|---|---|
| JP | 2019-500911 | A | 1/2019 |
| JP | 2019-089128 | A | 6/2019 |
| WO | 2016/147262 | A1 | 9/2016 |

OTHER PUBLICATIONS

International Search Report, PCT Patent Application No. PCT/JP2022/024973, Aug. 9, 2022, 5 pages.
Written Opinion, PCT Patent Application No. PCT/JP2022/024973, Aug. 2, 2022, 3 pages.

* cited by examiner

SLIDER FOR SLIDE FASTENER

TECHNICAL FIELD

The present invention relates to a slide fastener slider.

BACKGROUND ART

In general, a slider used for a slide fastener includes a slider body in which an upper blade and a lower blade are connected to each other by a guide column, and a pull tab held by the slider body, and a substantially Y-shaped element guide path through which left and right element rows are guided is formed between the upper blade and the lower blade. As such a slide fastener slider, a type of slider (split slider) is known in which a first slider member including a first blade (for example, a lower blade) and a second slider member including a second blade (for example, an upper blade) are molded separately and the first slider member and the second slider member are coupled to each other.

A split-type slider including a plurality of slider members can be easily attached to element rows of a fastener chain, for example, after members such as stoppers and separating inserts are provided on both ends of the element rows of the fastener chain. Such a split-type slider including a plurality of slider members is disclosed in, for example, Patent Literatures 1 to 3.

CITATION LIST

Patent Literature

Patent Literature 1: French Patent Application Publication No. 1600416
Patent Literature 2: Japanese Patent No. 5828960
Patent Literature 3: WO2016/147262A1

SUMMARY OF INVENTION

Technical Problem

The split type slider body as described above is implemented by coupling two slider members, and the two slider members are assembled together by engaging portions provided on the two slider members. In this case, it is necessary to secure a thickness for providing the engaging portion in each of the two slider members, and there is a problem that the slider becomes large.

Therefore, the present invention provides a slide fastener slider capable of preventing an increase in size of the slider without deteriorating workability of assembly.

Solution to Problem

The present invention has the following configuration.

A slide fastener slider including: a lower member; an upper member provided above the lower member so as to face the lower member; a cover attached above the upper member; and a pull tab held between the upper member and the cover, in which the lower member includes a lower blade, a guide column provided at a front end portion of the lower blade, an upper plate portion connected to the guide column and extending in a front and rear direction so as to face the lower blade, and an attachment column provided on the upper plate portion, the upper member includes a flat plate portion facing the lower blade and forming an upper blade together with the upper plate portion, an opening portion that is formed on the flat plate portion and that allows the attachment column to be inserted therethrough, and a placement portion that is formed in the flat plate portion and that is placed on the upper plate portion, the cover includes, at an end portion thereof in the front and rear direction, an engaging portion engaged with an engaged portion provided on the attachment column inserted through the opening portion so as to protrude upward from the flat plate portion, a shaft portion provided at one end of the pull tab is disposed in a space formed between the upper plate portion and the cover, and the placement portion is sandwiched between the engaging portion of the cover and the upper plate portion by attaching the cover to the attachment column by engaging the engaging portion of the cover with the engaged portion of the attachment column.

Advantageous Effects of Invention

According to the present invention, an increase in size of the slide fastener slider can be prevented without deteriorating workability of assembly.

DESCRIPTION OF EMBODIMENTS

Hereinafter, preferred embodiments of the present invention will be described in detail with reference to the drawings.

First Embodiment

Figure 1:
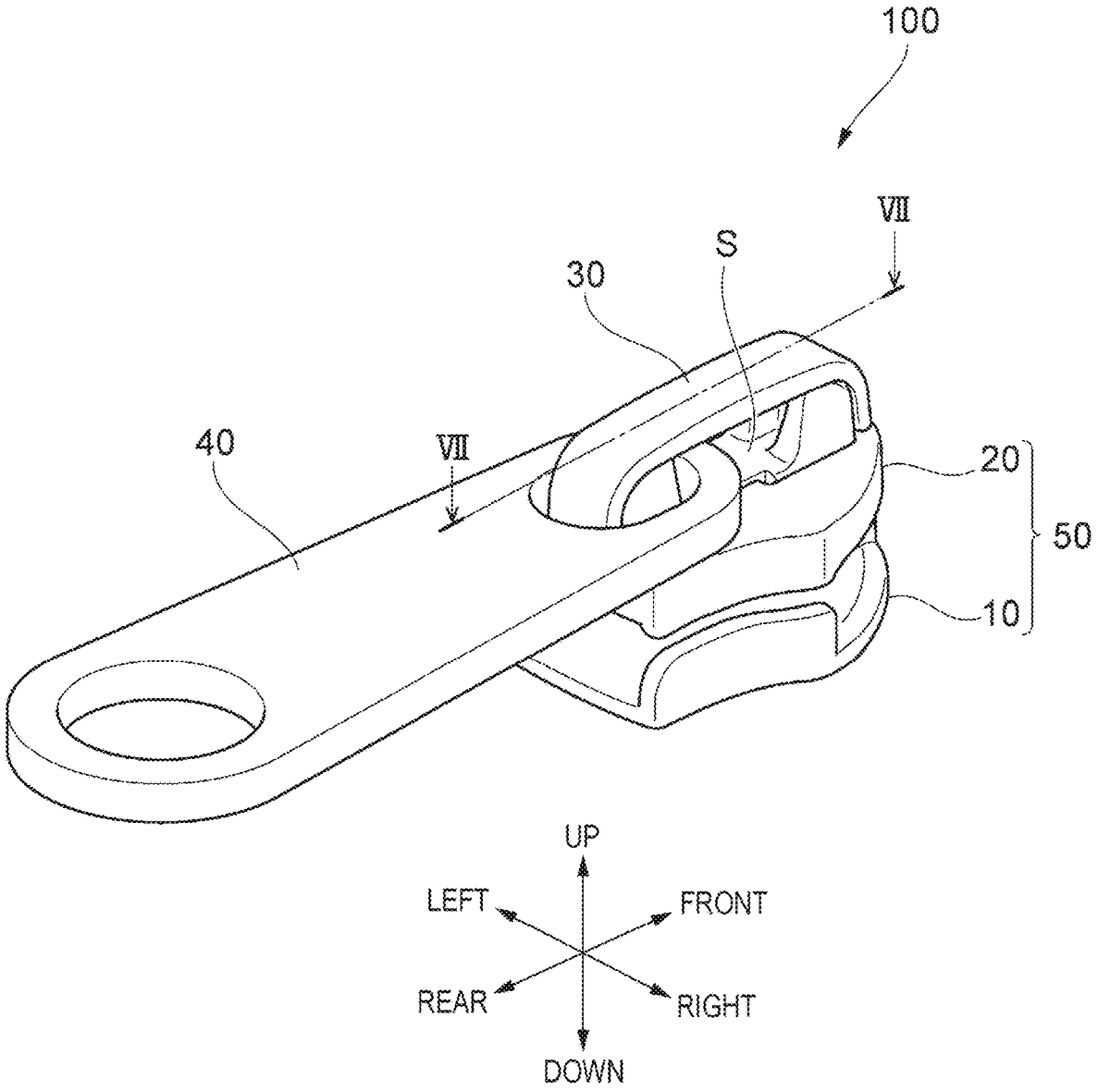
FIG. 1 is an overall perspective view of a slider according to a first embodiment of the present invention, as viewed from the rear.
Figure 2:
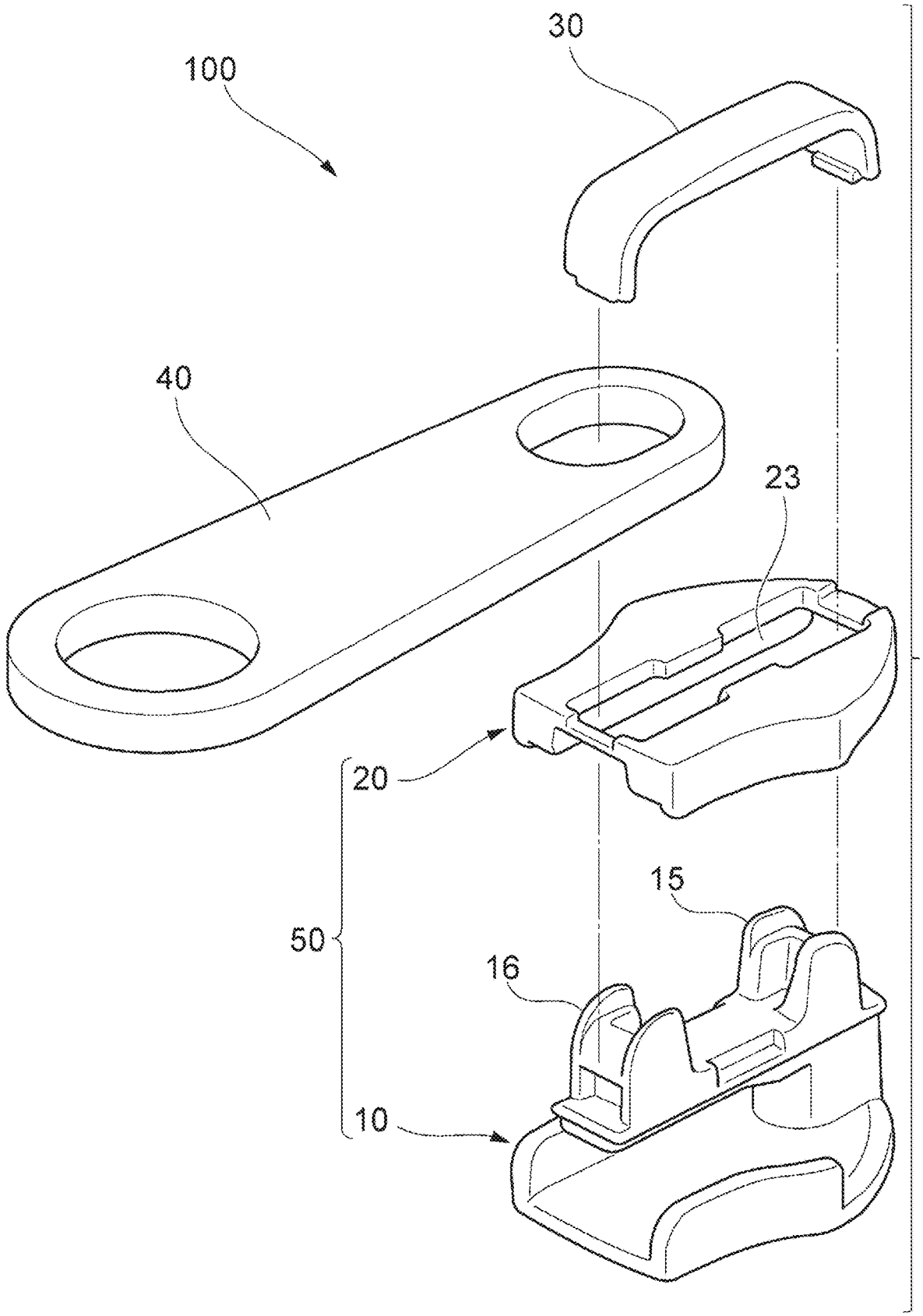
FIG. 2 is an exploded perspective view of the slide fastener slider illustrated in FIG. 1.

FIG. 1 is an overall perspective view of a slide fastener slider according to a first embodiment. FIG. 2 is an exploded perspective view of the slide fastener slider illustrated in FIG. 1.

In the following description, a sliding direction of the slide fastener slider (hereinafter, referred to as a slider) is defined as a front and rear direction, a direction in which the slider moves to cause element rows of the slide fastener to mesh with each other is defined as the front (a shoulder opening side direction), and a direction in which the slider moves to cause the element rows to separate from each other is defined as the rear (a rear opening side direction).

In addition, a height direction of the slider is defined as an up and down direction, a side exposed to the outside when the slide fastener is used (for example, a side on which a pull tab is attached to the slider body) is defined as an upper side, and an opposite side is defined as a lower side. Further, a direction orthogonal to the sliding direction and the up and down direction of the slider is defined as a width direction or a left and right direction of the slider.

As illustrated in FIGS. 1 and 2, a slider 100 according to the present embodiment includes a lower member 10, an upper member 20, a cover 30, and a pull tab 40. The lower member 10 and the upper member 20 are combined with each other to form a slider body 50 serving as a main body of the slider 100. The slider 100 according to the present embodiment is used for, for example, a so-called back-use type slide fastener in which element rows of left and right fastener stringers are arranged on a lower surface side with respect to a fastener tape. The slider 100 is not limited to the illustrated form. Further, a configuration of the pull tab 40 is not limited to the illustrated form.

The lower member 10 forms a bottom surface of the slider 100 and is disposed on a side (a back side) opposite to the side exposed to the outside when the slide fastener is used. The upper member 20 is provided above the lower member 10 so as to face the lower member 10. The cover 30 is attached above the upper member 20.

In the present embodiment, each of the lower member 10, the upper member 20, the cover 30, and the pull tab 40 is a metal or resin component formed of a single member. Each member is molded by a method such as injection molding or die casting, but the molding method is not particularly limited.

Figure 3:
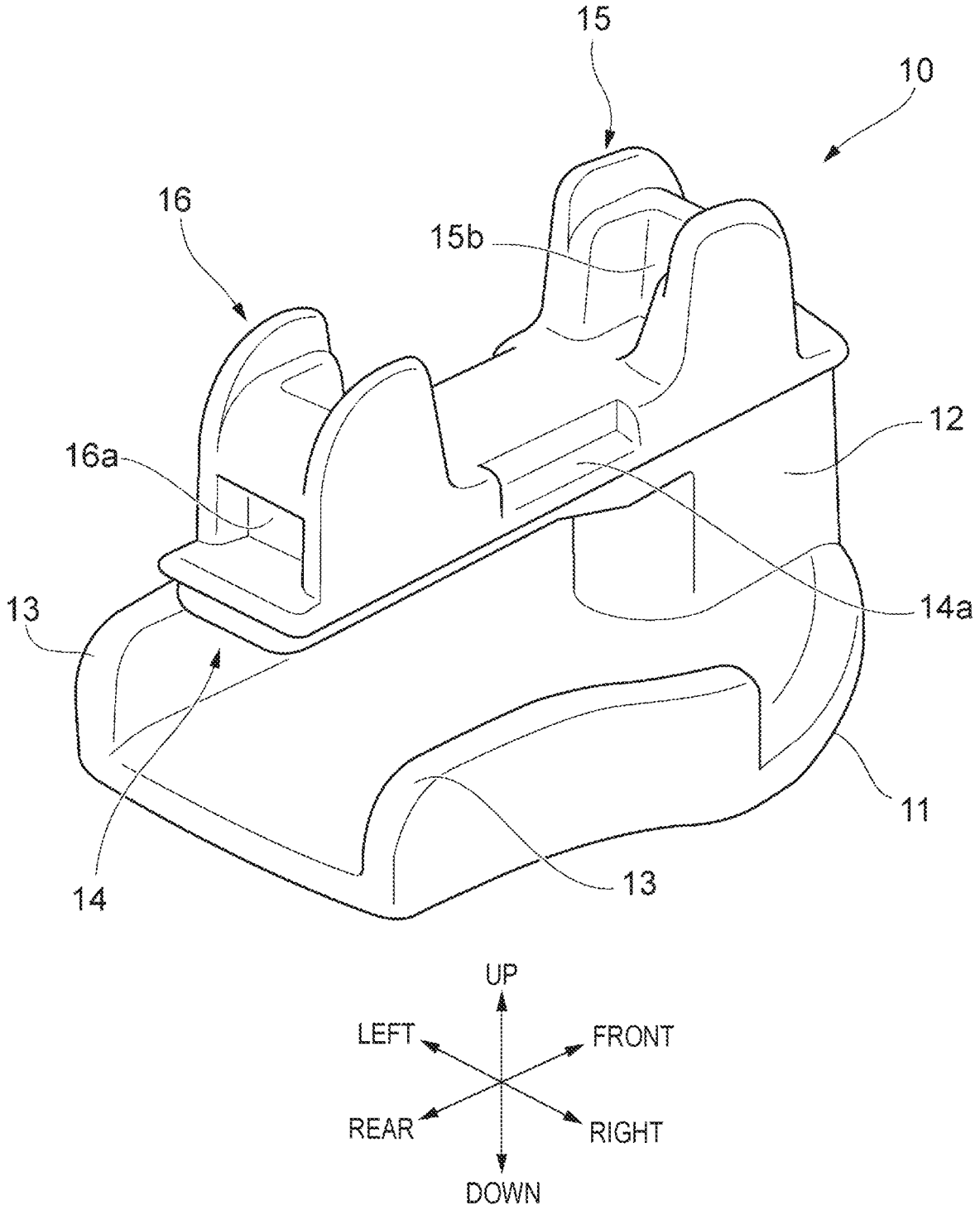
FIG. 3 is a perspective view of a lower member.

FIG. 3 is a perspective view of the lower member 10.

The lower member 10 includes a lower blade 11, a guide column 12, a pair of lower flange portions 13, an upper plate portion 14, a front attachment column 15, and a rear attachment column 16. The lower member 10 supports the upper member 20 (FIG. 2), which is placed on an upper side, by the upper plate portion 14.

The lower blade 11 is a flat plate-shaped member serving as the bottom surface of the slider 100. The guide column 12 extending upward is provided at a front end portion of the lower blade 11. At the front end portion of the lower blade 11, shoulder openings are formed on both sides of the guide column 12 in the left and right direction, and a rear opening is formed at a rear end of the lower blade 11. The pair of lower flange portions 13 are erected along left and right side edge portions of the lower blade 11 on a rear end side of the lower blade 11.

The upper plate portion 14 is connected to the guide column 12 and is formed to extend in the front and rear direction while facing the lower blade 11 and maintaining a predetermined distance from the lower blade 11 in the up and down direction. The front attachment column 15 is provided at a front end portion of the upper plate portion 14, and the rear attachment column 16 is provided at a rear end of the upper plate portion 14. Details of the front attachment column 15 and the rear attachment column 16 will be described later.

Figure 4:
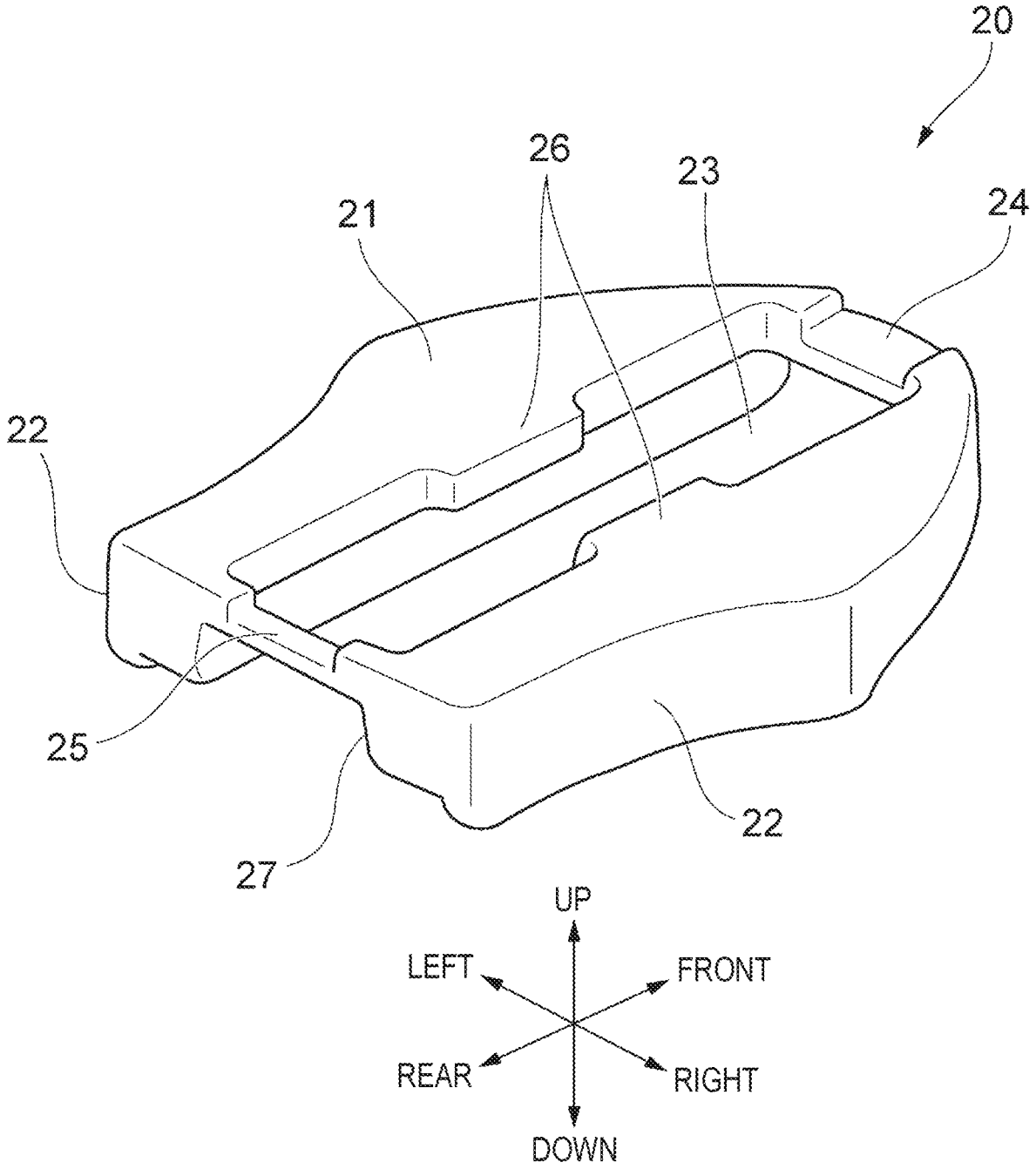
FIG. 4 is a perspective view illustrating an upper member.

FIG. 4 is a perspective view illustrating the upper member 20.

The upper member 20 includes a flat plate portion 21, a pair of upper flange portions 22, an opening portion 23, a front placement portion 24, and a rear placement portion 25. The upper member 20 is a member that is attached to the lower member 10 (FIG. 2) from above and covers the upper plate portion 14 of the lower member 10.

The flat plate portion 21 is a flat plate-shaped portion forming a contour of the upper member 20, and is provided above the lower blade 11 (FIG. 3) so as to face the lower blade 11. The pair of upper flange portions 22 are formed to protrude downward along left and right side edge portions of the flat plate portion 21. The opening portion 23 is formed substantially in a center of a plane of the flat plate portion 21. When the slider 100 is assembled, which is to be described later, the front attachment column 15 and the rear attachment column 16 of the lower member 10 illustrated in FIG. 2 are inserted through the opening portion 23. The opening portion 23 is formed in a size and a shape that allow the front attachment column 15 and the rear attachment column 16 to be inserted therethrough. In this example, one substantially rectangular opening portion 23 is formed to extend in the front and rear direction of the flat plate portion 21. Therefore, when the upper member 20 is assembled to the lower member 10, the front attachment column 15 and the rear attachment column 16 can be easily inserted through the opening portion 23.

The front placement portion 24 is provided at a front end of the flat plate portion 21 and in front of the opening portion 23, and the rear placement portion 25 is provided at a rear end of the flat plate portion 21 and in rear of the opening portion 23. The front placement portion 24 and the rear placement portion 25 are recessed from an upper surface of the flat plate portion 21, and are disposed below the flat plate portion 21 by a predetermined distance. That is, thicknesses of the front placement portion 24 and the rear placement portion 25 in the up and down direction are thinner than a thickness of the flat plate portion 21 at other positions. The front placement portion 24 and the rear placement portion 25 are placed on the upper plate portion 14 of the lower member 10 when the slider 100 is assembled, which is to be described later.

The upper member 20 further includes a pair of central protrusions 26 protruding from outer edges of the opening portion 23 toward the inside of the opening portion 23. The central protrusions 26 are placed on a pair of step portions 14*a* (only the step portion 14*a* on a front side is illustrated) formed on the upper plate portion 14 of the lower member 10 illustrated in FIG. 3 when the slider 100 is assembled. A groove portion 27 that covers the upper plate portion 14 of the lower member 10 is formed on a lower surface of the upper member 20 along the front and rear direction. Details of the central protrusion 26 and the groove portion 27 will be described later. Since the groove portion 27 is formed, a thickness of the central protrusion 26 in the up and down direction is thinner than the thickness of the flat plate portion 21 at other positions. Further, the thicknesses of the front placement portion 24 and the rear placement portion 25 in the up and down direction are formed to be smallest in the upper member 20 due to the groove portion 27 and the recesses of the upper surface.

Figure 5A:
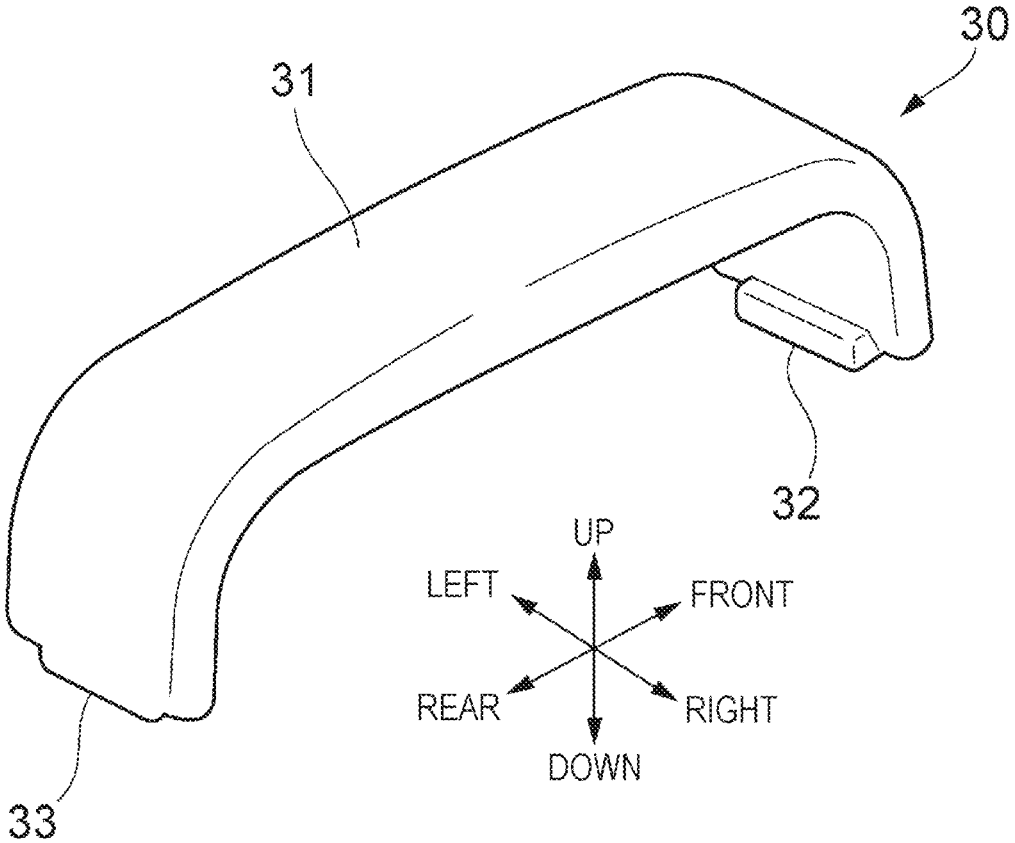
FIG. 5A is a perspective view of a cover.
Figure 5B:
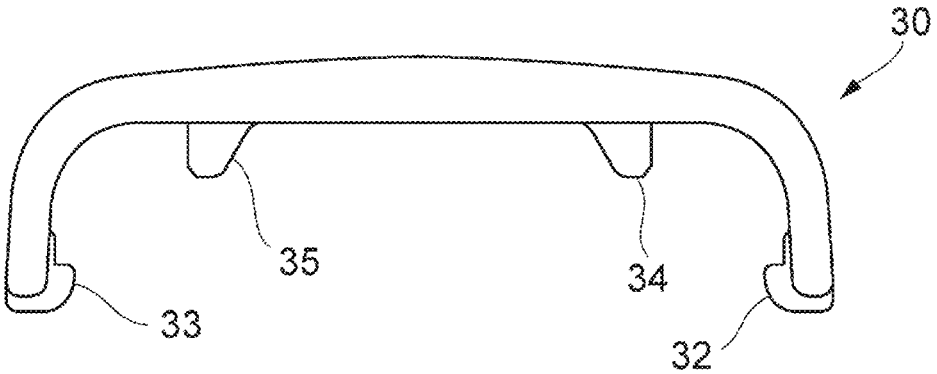
FIG. 5B is a side view of the cover.
Figure 5C:
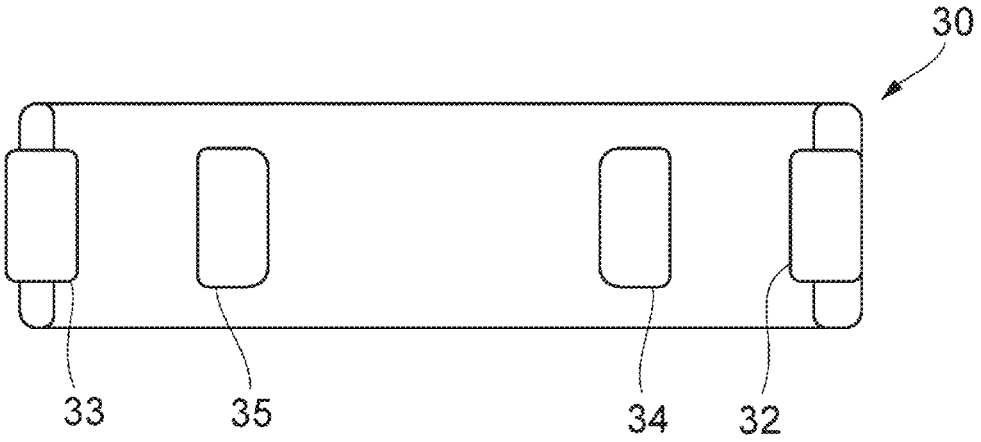
FIG. 5C is a rear view of the cover.

FIG. 5A is a perspective view of the cover 30, FIG. 5B is a side view of the cover 30, and FIG. 5C is a rear view of the cover 30.

The cover 30 has an approximately U-shape with both end portions in a longitudinal direction bent to the same side, and includes a main body 31, a front engaging portion 32 provided at one end (a front end) of the main body 31, and a rear engaging portion 33 provided at another end (a rear end) of the main body 31. The cover 30 further includes a front protruding portion 34 and a rear protruding portion 35 that protrude toward a bent side of the both end portions.

As illustrated in FIG. 2, the cover 30 is attached to the front attachment column 15 and the rear attachment column 16 from a portion above the upper member 20. At this time, a shaft portion 41 provided at one end of the pull tab 40 is held in a state of being movable in the front and rear direction, the up and down direction, and the left and right direction in a space S formed between the upper plate portion 14 of the lower member 10 and the cover 30 in the up and down direction.

Figure 6:
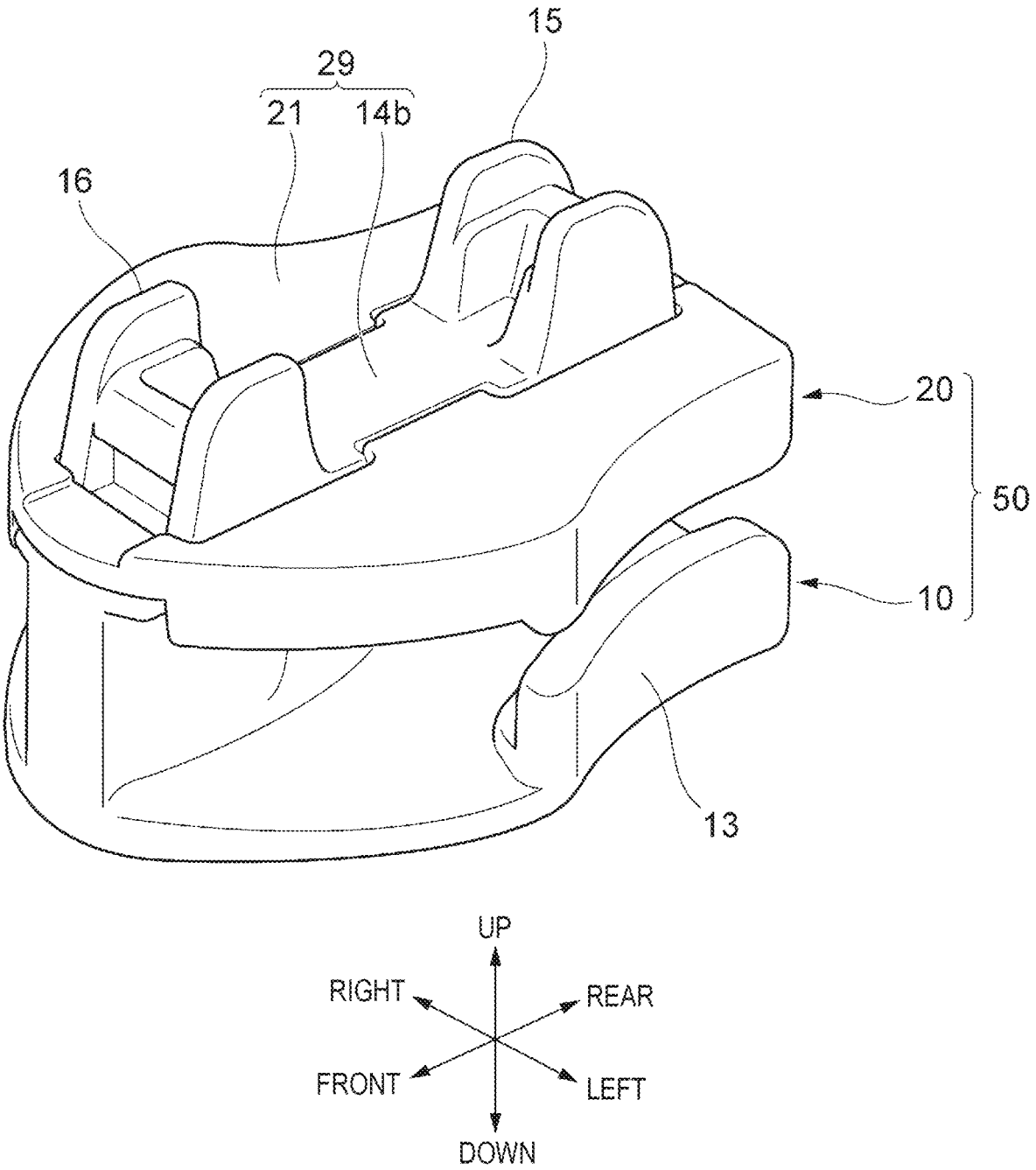
FIG. 6 is a perspective view of a slider body in which the lower member and the upper member are assembled.

FIG. 6 is a perspective view of the slider body 50 in which the lower member 10 and the upper member 20 are assembled. In the following description, the same members or the same portions are denoted by the same reference signs, and the description thereof will be omitted or simplified.

An upper surface 14*b* of the upper plate portion 14 in a region between the front attachment column 15 and the rear attachment column 16 and the upper surface of the flat plate portion 21 of the upper member 20 are flush with each other to form an upper blade 29.

Figure 7:
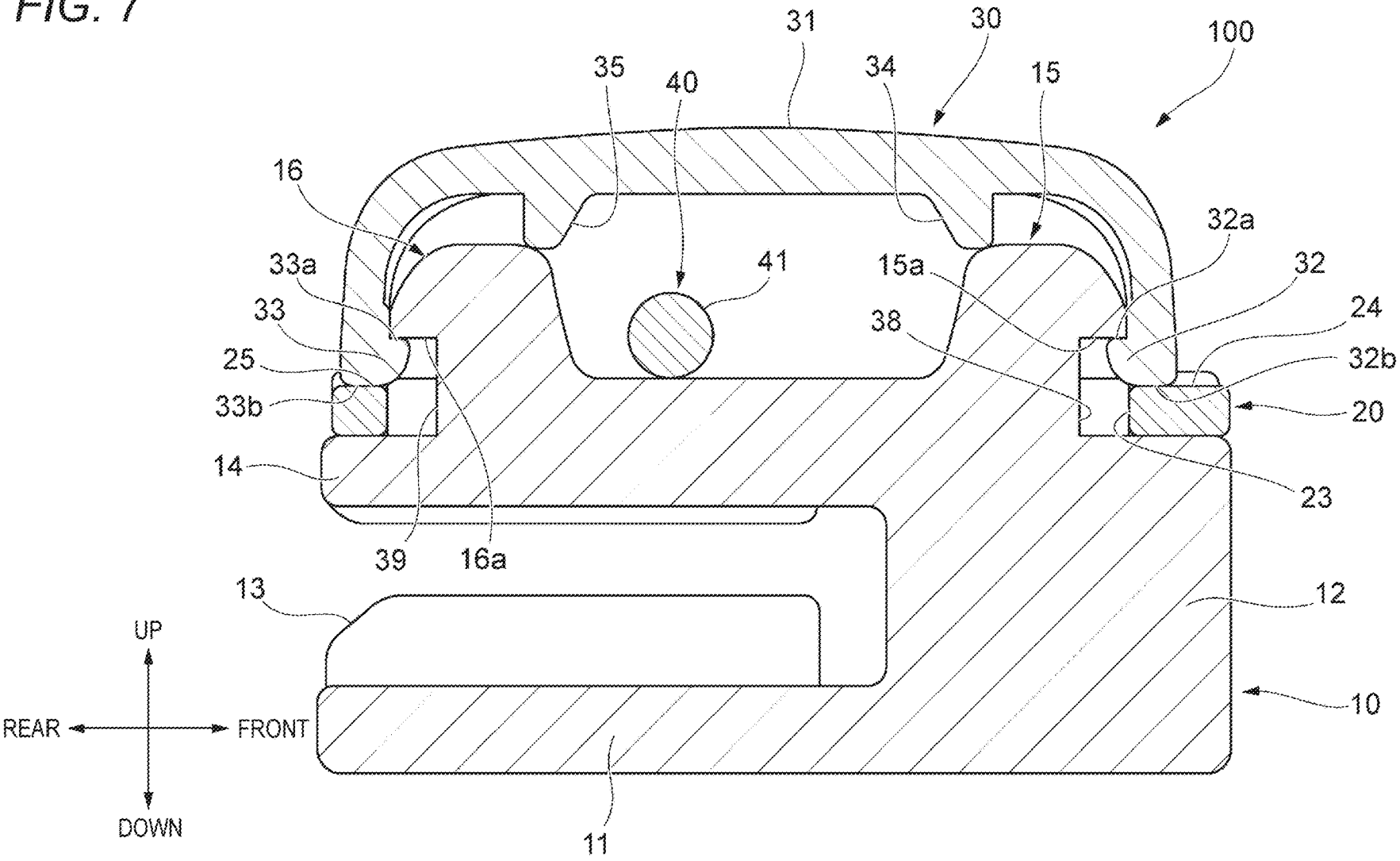
FIG. 7 is a cross-sectional view of the assembled slider illustrated in FIG. 1 taken along a line VII-VII.

FIG. 7 is a cross-sectional view of the assembled slider 100 illustrated in FIG. 1 taken along a line VII-VII.

The front attachment column 15 and the rear attachment column 16 of the lower member 10 protrude upward from the opening portion 23 of the upper member 20. A front recess 38 recessed rearward is formed at a front end of the front attachment column 15, and an inner upper surface of the front recess 38 forms an engaged portion 15*a*. Similarly, in the rear attachment column 16, a rear recess 39 recessed forward is formed at a rear end of the rear attachment column 16, and an inner upper surface of the rear recess 39 forms an engaged portion 16*a*.

The front engaging portion 32 of the cover 30 has a facing surface 32*a* facing the engaged portion 15*a*, and the rear engaging portion 33 has a facing surface 33*a* facing the engaged portion 16*a*. In a state in which the cover 30 is attached to the upper member 20, the facing surface 32*a* of the front engaging portion 32 is engaged with the engaged portion 15*a* of the front attachment column 15, and the facing surface 33*a* of the rear engaging portion 33 is engaged with the engaged portion 16*a* of the rear attachment column 16.

In a state in which the front engaging portion 32 is engaged with the engaged portion 15*a*, the front placement portion 24 of the upper member 20 is sandwiched between a tip end 32*b* of the front engaging portion 32 of the cover 30 and the upper plate portion 14. In a state in which the rear engaging portion 33 is engaged with the engaged portion 16*a*, the rear placement portion 25 of the upper member 20 is sandwiched between the tip end 33*b* of the rear engaging portion 33 of the cover 30 and the upper plate portion 14.

As described above, in the slider 100 having the present configuration, the engagement between the lower member 10 and the upper member 20 is achieved by the engagement between the lower member 10 and an end portion (a front end, a rear end) of the cover 30 disposed above the upper member 20. That is, the end portion of the cover 30 is engaged with the attachment column (the front attachment column 15, the rear attachment column 16) of the lower member 10, and cooperates with the upper plate portion 14 which is a part of the lower member 10, so as to fix the upper member 20 by the placement portion (the front placement portion 24, the rear placement portion 25).

In addition, since the cover 30 is engaged with the engaged portions 15*a* and 16*a* and a vertical movement thereof is restricted by the front placement portion 24 and the rear placement portion 25, even when the shaft portion 41 at one end of the pull tab 40 is pulled upward or pushed downward, the cover 30 does not fall off from the lower member 10.

Figure 8:
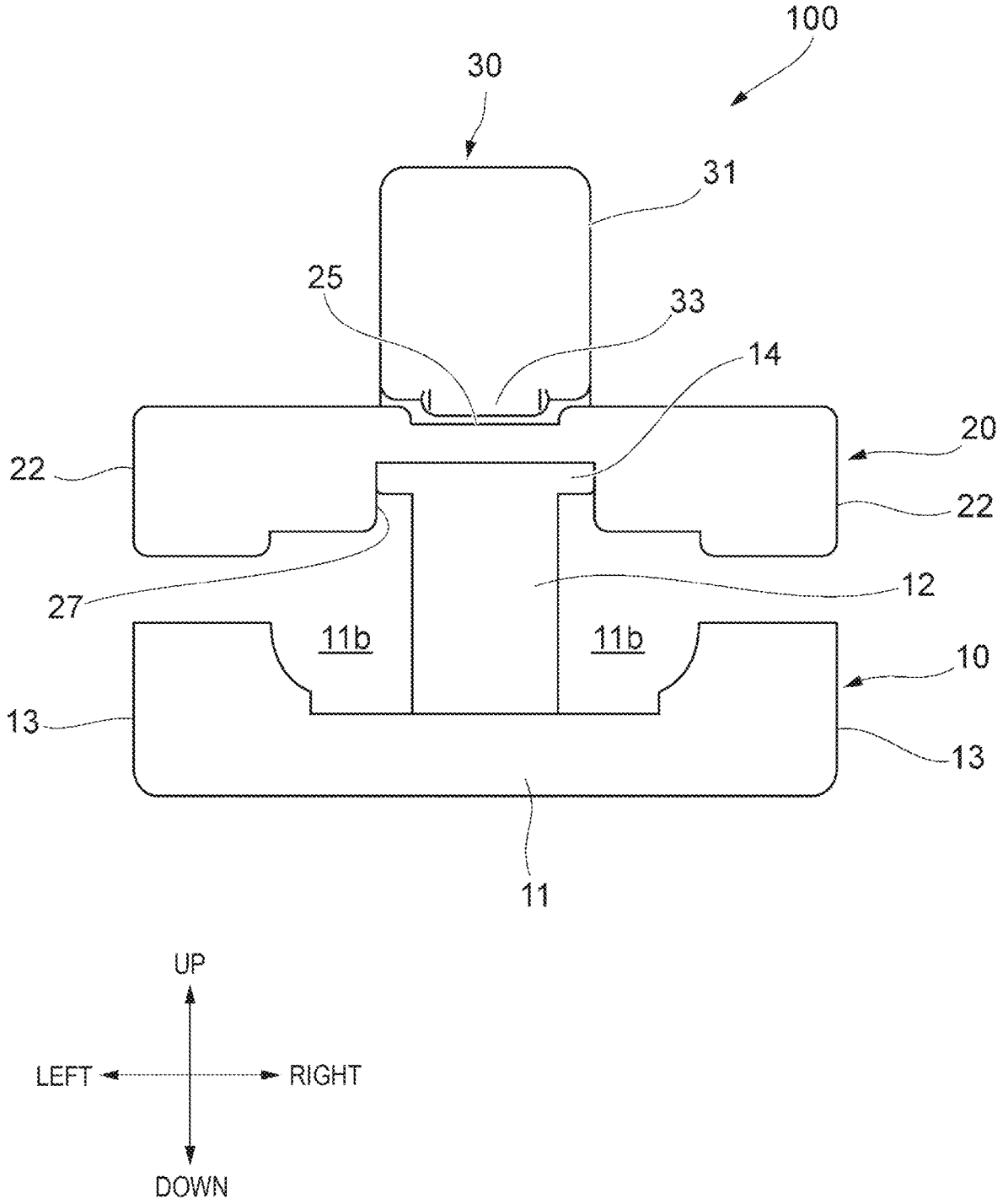
FIG. 8 is a front view of the assembled slider as viewed from the rear of the slider.

FIG. 8 is a front view of the assembled slider 100 as viewed from the rear of the slider. However, the pull tab 40 is not illustrated in FIG. 8.

In the slider 100, an element guide path 11*b* connecting the left and right shoulder openings with the rear opening is formed in a manner of being surrounded by the upper member 20, the lower blade 11, and the pair of left and right lower flange portions 13. The element guide path 11*b* has a substantially Y shape in plan view. In this case, an inner wall surface (an element guide surface) of the element guide path 11*b* is formed by the lower surface of the upper member 20, an upper surface of the lower blade 11, inner wall surfaces of the pair of left and right lower flange portions 13, and inner wall surfaces of the pair of left and right upper flange portions 22.

Accordingly, when the slider 100 advances forward along the element rows (not illustrated), the two separated element rows pass through the element guide path 11*b* in a direction from the shoulder opening to the rear opening and mesh with each other. When the slider 100 advances rearward, the two meshed element rows pass through the element guide path 11*b* in a direction from the rear opening to the shoulder opening and are separated from each other.

Also in the related slider, two members forming the element guide path 11*b*, such as the lower member 10 and the upper member 20 according to the present embodiment, are assembled in the up and down direction. However, when assembling the lower member and the upper member in the related art, the lower member and the upper member are generally engaged with each other by an engagement mechanism provided between the two members. That is, the engagement mechanism is disposed in a space through which the elements of the slide fastener pass, and therefore, the two members are required to have an interval including at least a thickness of the engagement mechanism. As a result, the thickness of the slider (the thickness of the slider body) increases, which may cause problems such as an increase in size including the size and weight of the slider, an increase in cost, and restrictions on usage situations and design.

On the other hand, in the slider 100 according to the present embodiment, the engagement between the lower member 10 and the upper member 20 is achieved at the position of the placement portion (the front placement portion 24 or the rear placement portion 25) of the upper member 20, not at the space between the two members as in the related slider. The position of the placement portion is substantially the same as the upper surface of the flat plate portion 21 which corresponds to an upper surface of the upper member 20, and is at least not in the region between the two members, but is above the region between the two members. Accordingly, in the present embodiment, an increase in the thickness of the assembled slider 100 (specifically, the thickness of the slider body 50) is prevented, which makes the above problem less likely to occur.

The placement portion (the front placement portion 24 or the rear placement portion 25) of the upper member 20 is recessed from the flat plate portion 21, and an upper surface thereof is provided at a position below the flat plate portion 21 by a predetermined distance. Accordingly, when the engaging portions (the front engaging portion 32 and the rear engaging portion 33) of the cover 30 are engaged with the engaged portions 15*a* and 16*a* of the attachment columns (the front attachment column 15, the rear attachment column 16), the protrusion amount of the cover 30 in a height direction is reduced. This can contribute to downsizing of the slider 100. Since the placement portion of the upper member 20 is recessed with respect to the surrounding flat plate portion 21, the engaging portions (the front engaging portion 32 and the rear engaging portion 33) of the cover 30 are stably positioned on the placement portion.

Further, the pair of central protrusions 26 of the upper member 20 illustrated in FIG. 4 are placed on the pair of step portions 14*a* (FIG. 3) formed on the upper plate portion 14 of the lower member 10 when the slider 100 is assembled. The pair of step portions 14*a* has a stepped shape formed in a central portion of the upper plate portion 14 in the front and rear direction, and has a shape corresponding to the shape of the central protrusion 26. The positioning accuracy of the lower member 10 and the upper member 20 can be improved by engaging the central protrusion 26 with the step portion 14*a*.

As illustrated in FIG. 8, the groove portion 27 that covers the upper plate portion 14 of the lower member 10 is formed along the front and rear direction on the lower surface of the upper flange portion 22 of the upper member 20 facing the lower blade 11. The groove portion 27 is formed in a size capable of accommodating the upper plate portion 14 of the lower member 10, and accommodates the upper plate portion 14 of the lower member 10 when the slider 100 is assembled. When the upper plate portion 14 and the groove portion 27 are engaged with each other, a posture of the upper member 20 is stabilized, and the positioning accuracy of the lower member 10 and the upper member 20 can be improved. The groove portion 27 can regulate a height of the element guide path 11*b*, which makes the element rows (not illustrated) passing through the element guide path 11*b* to be favorably meshed with each other.

Modification

Figure 9:
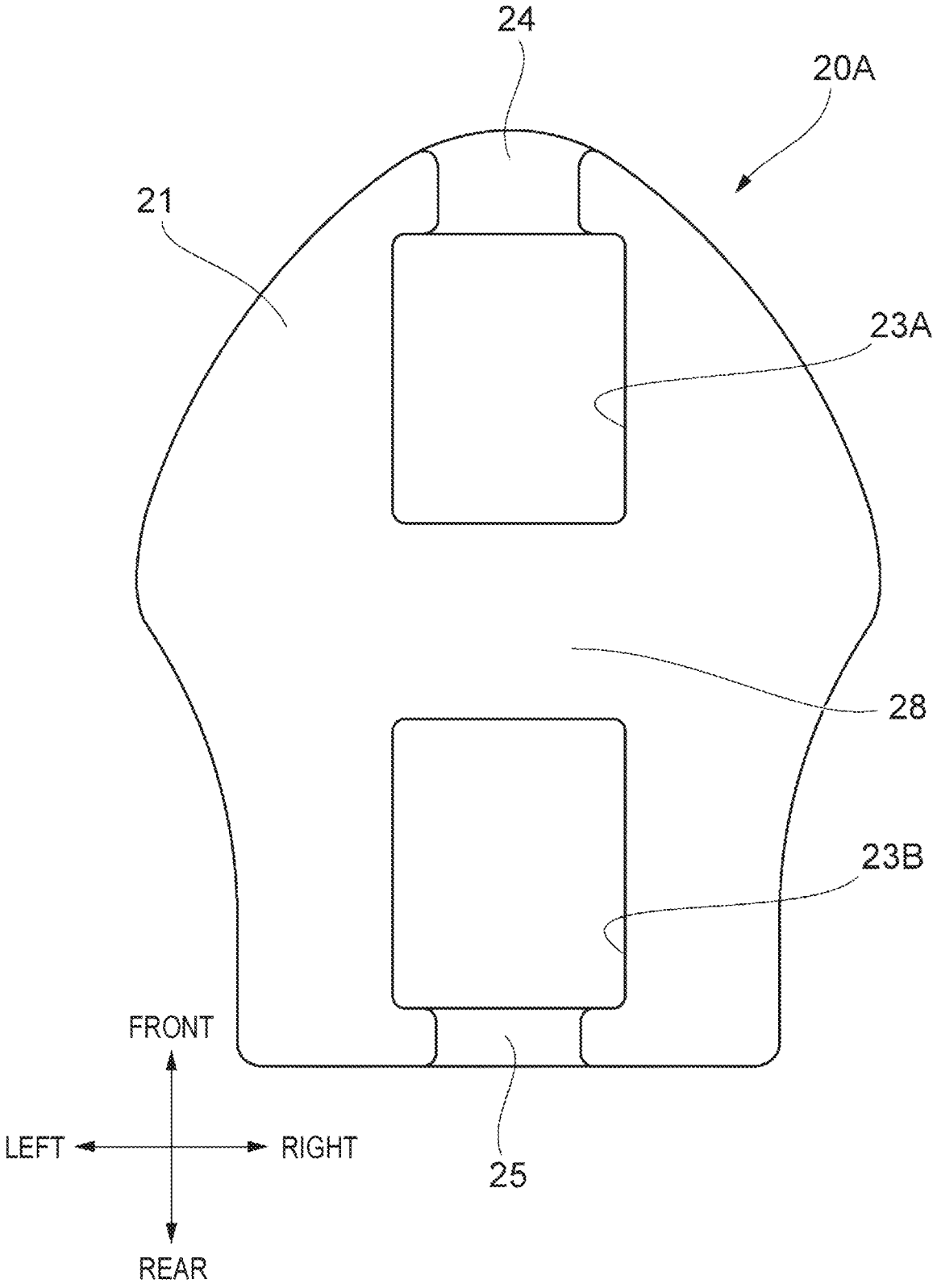
FIG. 9 is a plan view of an upper member including a central placement portion.

FIG. 9 is a plan view of an upper member 20A including a central placement portion 28.

The upper member 20A according to a modification includes a central placement portion 28 at an intermediate portion in the front and rear direction of the flat plate portion 21, a front opening portion 23A is formed in front of the central placement portion 28, and a rear opening portion 23B is formed in rear of the central placement portion 28. That is, by providing the central placement portion 28, the opening portion 23 (FIG. 4) of the upper member 20 described above is divided into two in the front and rear direction.

In the upper member 20A according to the present configuration, in addition to the front placement portion 24 and the rear placement portion 25, the central placement portion 28 having an area larger than that of the central protrusion 26 is disposed on the upper plate portion 14 of the lower member 10 illustrated in FIG. 3, thereby increasing a support area of the upper member 20A and stabilizing a posture of the upper member 20A placed on the lower member 10. In the upper member 20A, a total area of the opening portion 23 can be reduced as compared with the upper member 20 illustrated in FIG. 4, and thus the mechanical strength is improved.

<Assembly Steps of Slider>

Next, assembly steps of the slider 100 will be described.

FIGS. 10A to 10E are step diagrams each illustrating the assembly steps of the slider 100 in stages. Each assembling operation is performed by an appropriate automatic assembling apparatus.

Figure 10A:
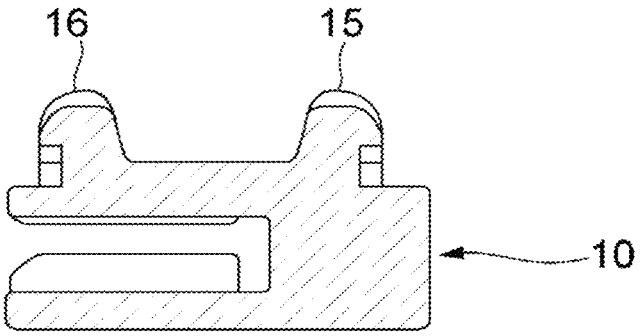
FIG. 10A is a step diagram illustrating assembly steps of the slider in stages.
Figure 10B:
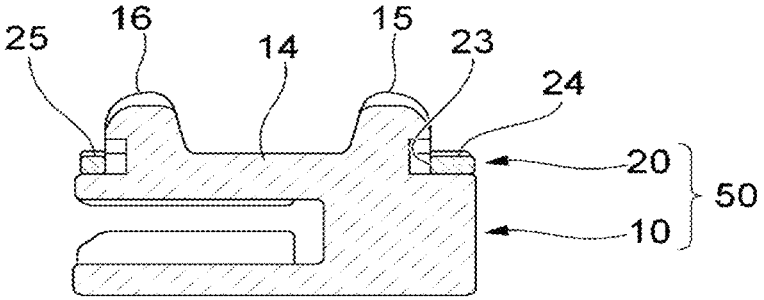
FIG. 10B is a step diagram illustrating the assembly steps of the slider in stages.

As illustrated in FIG. 10A, the lower member 10 is prepared (a first step). Next, as illustrated in FIG. 10B, the upper member 20 is placed on the lower member 10 to form the slider body 50 (a second step). At this time, the upper surface of the upper plate portion 14, the front attachment column 15, and the rear attachment column 16 protrude upward from the opening portion 23. The front placement portion 24 and the rear placement portion 25 are placed on the upper plate portion 14. At this stage, the upper member 20 is only placed on the lower member 10, and the upper member 20 and the lower member 10 are not engaged with each other.

Figure 10C:
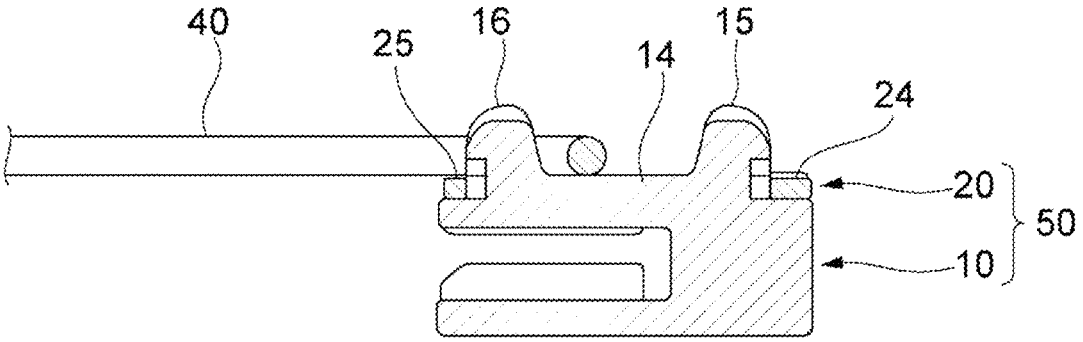
FIG. 10C is a step diagram illustrating the assembly steps of the slider in stages.

Next, as illustrated in FIG. 10C, the shaft portion 41 of the pull tab 40 is temporarily placed in the region between the front attachment column 15 and the rear attachment column 16 on the upper plate portion 14 (a third step). Then, as illustrated in FIGS. 10D and 10E, the cover 30 is attached to the front attachment column 15 and the rear attachment column 16 (a fourth step).

Figure 10D:
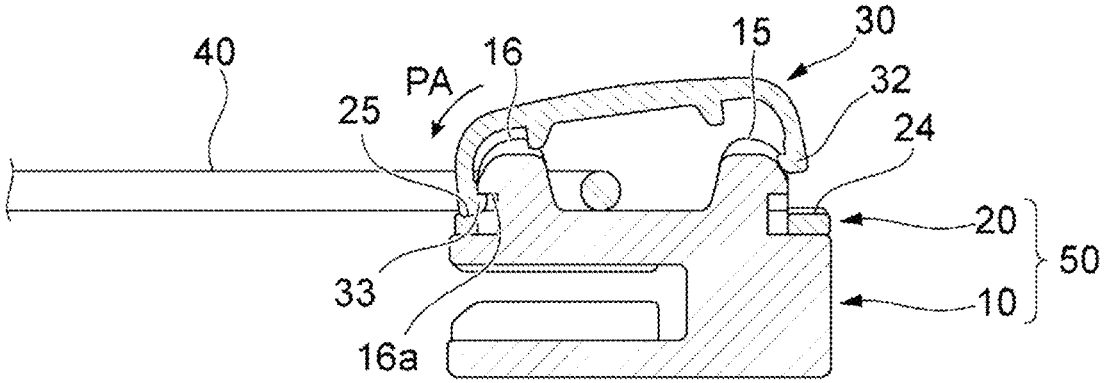
FIG. 10D is a step diagram illustrating the assembly steps of the slider in stages.
Figure 10E:
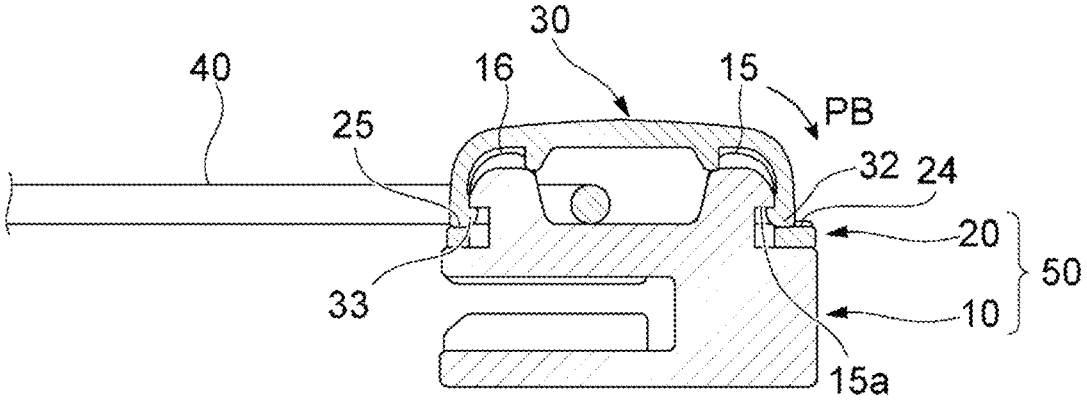
FIG. 10E is a step diagram illustrating the assembly steps of the slider in stages.

Regarding the cover 30, in order to fix the pull tab 40 first, the rear engaging portion 33 of the cover 30 is first hooked onto the engaged portion 16*a* of the rear attachment column 16 as indicated by an arrow PA in FIG. 10D. Then, the front engaging portion 32 of the cover 30 is engaged with the engaged portion 15*a* of the front attachment column 15 as indicated by an arrow PB in FIG. 10E. Accordingly, the lower member 10, the upper member 20, and the cover 30 are integrally assembled in a state in which the pull tab 40 is held between the lower member 10 and the cover 30, and the assembly of the slider 100 is completed.

In the assembly steps of the slider 100 according to the present embodiment, the respective members are simply stacked upward, and thus the assembly procedure is not complicated, and the assembly steps are suitable for automation. Since the cover 30 is attached after the pull tab 40 is disposed, if the pull tab is accommodated in the space between the cover 30 and the lower member 10, the pull tab can be easily applied, and various existing pull tabs can be easily used. The pull tab 40 and the cover 30 can be attached by one operation, and the assembly step can be simplified.

Second Embodiment

Next, a slide fastener slider according to a second embodiment will be described.

Figure 11:
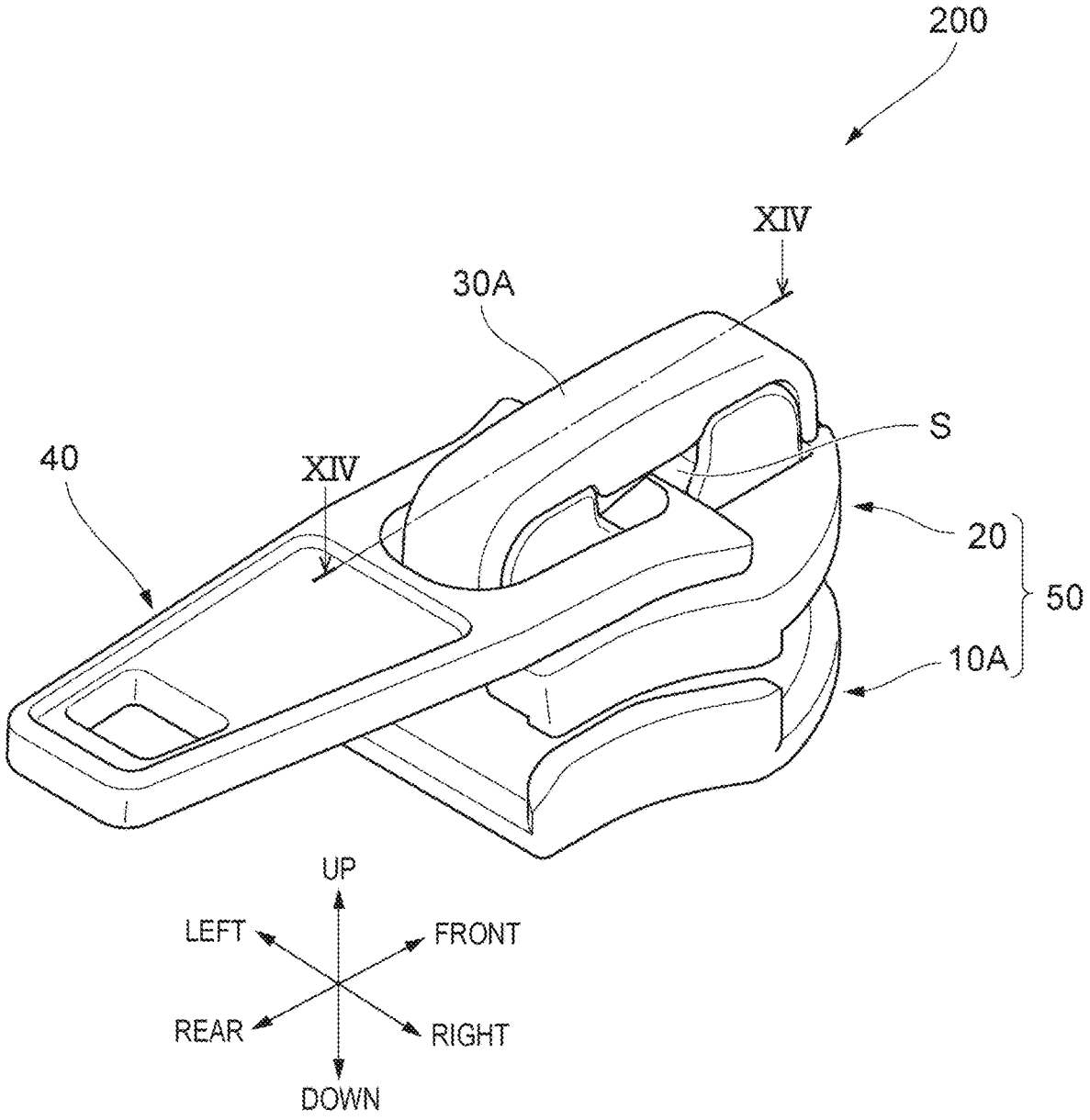
FIG. 11 is an overall perspective view of a slide fastener slider according to a second embodiment.
Figure 12:
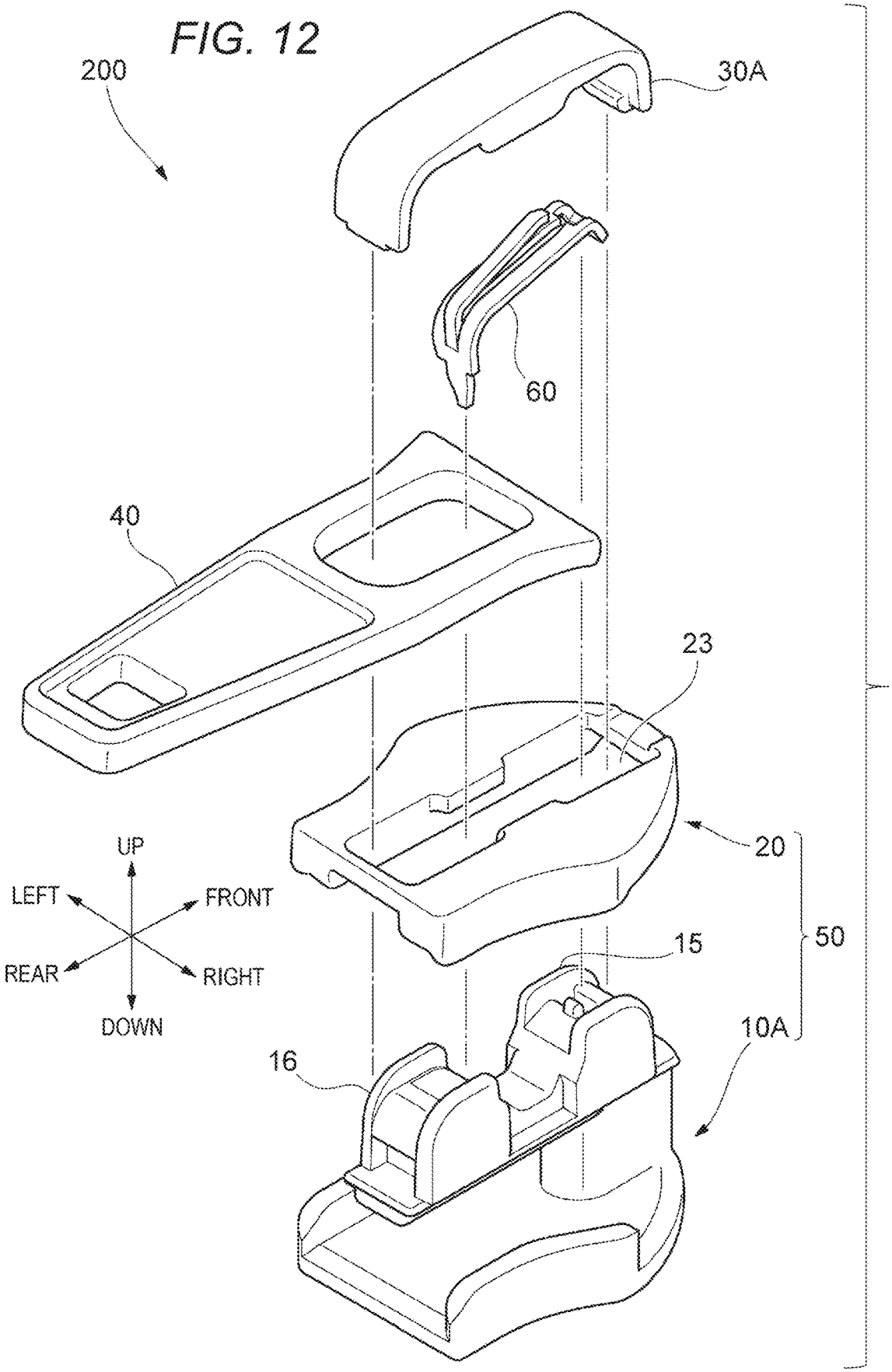
FIG. 12 is an exploded perspective view of the slide fastener slider illustrated in FIG. 11.

FIG. 11 is an overall perspective view of the slide fastener slider according to the second embodiment. FIG. 12 is an exploded perspective view of the slide fastener slider illustrated in FIG. 11.

A slider 200 according to the second embodiment includes a lower member 10A, the upper member 20, a cover 30A, and the pull tab 40. The slider 200 has the same configuration as the slider 100 according to the first embodiment except that the slider 200 includes the cover 30A, a lock pin 60 illustrated in FIG. 12, and a mechanism for supporting the lock pin 60.

In a locked state, the lock pin 60 prevents the slider 200 from moving with respect to element rows (not illustrated). Specifically, the lock pin 60 always keeps the slider 200 in the locked state. When a user pulls the pull tab 40 upward, the locked state of the slider 200 achieved by the lock pin 60 is released, and the slider 200 becomes able to move in a front and rear direction with respect to the element rows.

Figure 13:
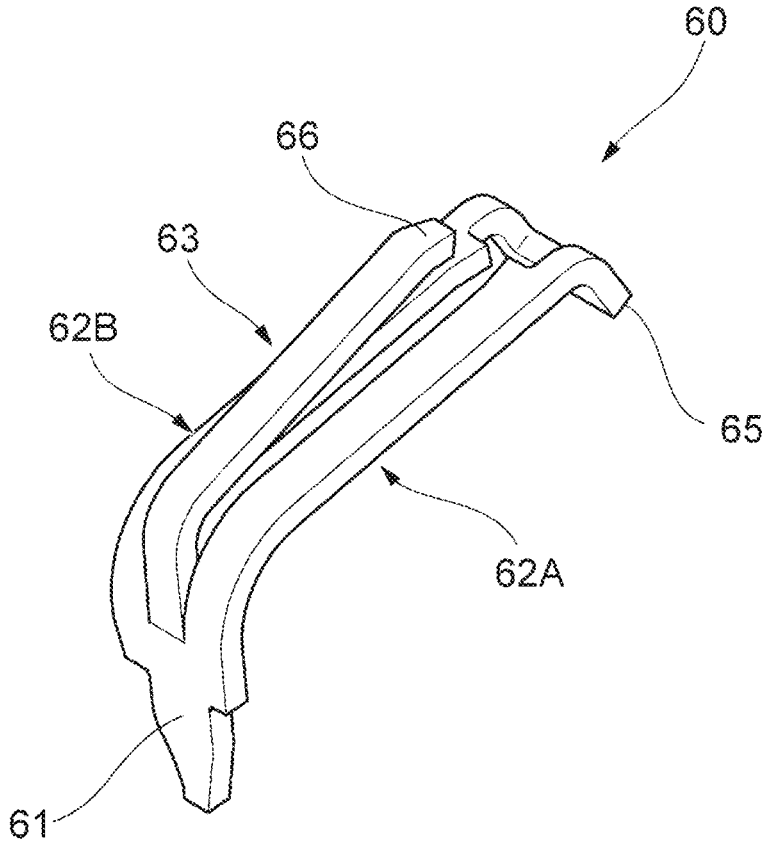
FIG. 13 is an enlarged perspective view of a lock pin.

FIG. 13 is an enlarged perspective view of the lock pin 60.

The lock pin 60 is made of a metal material such as a copper alloy or stainless steel, and includes a base portion 61, two lower locking members 62A and 62B, and an upper elastic member 63. The lower locking members 62A, 62B branch off and extend forward from both left and right ends of the base portion 61, and tip ends thereof are integrated to form a front locking portion 65. The upper elastic member 63 extends forward from a central portion of the base portion 61 in a left and right direction. The upper elastic member 63 is disposed above the two lower locking members 62A and 62B.

Figure 14:
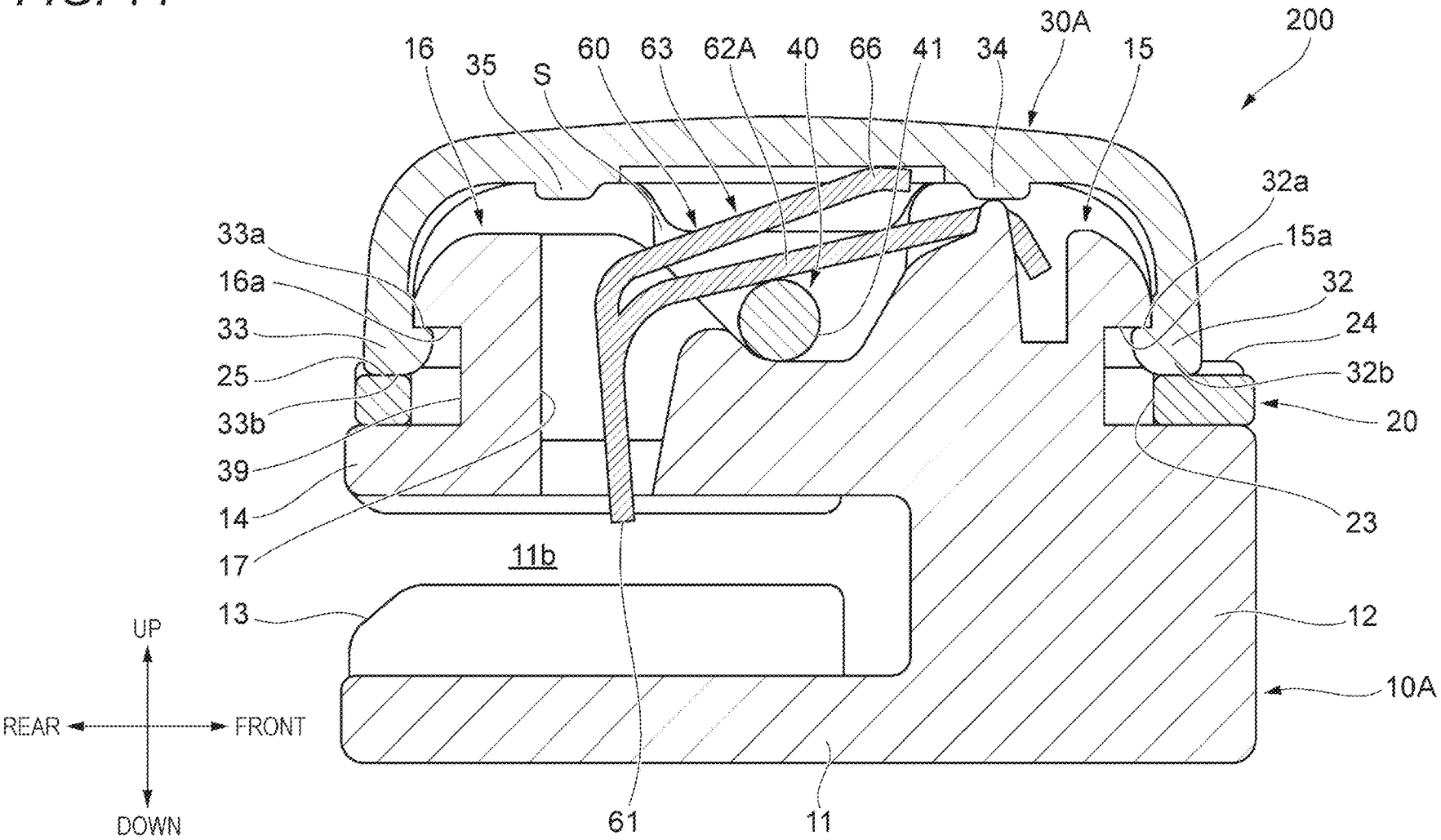
FIG. 14 is a cross-sectional view taken along a line XIV-XIV illustrated in FIG. 11.

FIG. 14 is a cross-sectional view taken along a line XIV-XIV illustrated in FIG. 11.

The lock pin 60 is disposed to extend in the front and rear direction in the space S (FIG. 11) formed between the upper plate portion 14 and the cover 30A. The base portion 61 of the lock pin 60 is disposed in the rear of the slider 200, and the front locking portion 65 at the tip ends of the elongated lower locking members 62A and 62B are locked to the front attachment column 15. A through hole 17 is formed in a part of the upper plate portion 14 including the rear attachment column 16, and the base portion 61 of the lock pin 60 is inserted into the through hole 17.

In other words, respective ends of the lower locking members 62A and 62B and the elongated upper elastic member 63, which serve as another end in the longitudinal direction, are each supported by the front attachment column 15, so that the base portion 61, which serves as one end of the lock pin 60 in a longitudinal direction, is freely movable from the through hole 17 of the upper plate portion 14 toward the lower member 10. A tip end portion 66 of the upper elastic member 63 presses the cover 30 upward to urge the base portion 61 downward. An intermediate portion between one end and the other end of the lock pin 60 is disposed in the space S, and the shaft portion 41 of the pull tab 40 is disposed between the intermediate portion and the upper plate portion 14.

In the locked state achieved by the lock pin 60, the base portion 61 penetrates through the through hole 17 and protrudes downward from a lower surface of the upper plate portion 14. Accordingly, the base portion 61 protrudes into the element guide path 11*b* through which the element rows pass, and a tip end of the base portion 61 enters between the elements to lock the slider 100.

When the user pulls the pull tab 40 upward, the shaft portion 41 of the pull tab 40 lifts the two lower locking members 62A and 62B upward. In conjunction with this, the base portion 61 also moves upward. Accordingly, the element rows are released from the lock achieved by the base portion 61, and the slider 100 is unlocked. Accordingly, the user can move the slider 100 in the front and rear direction while lifting the pull tab 40.

When the user lowers the lifted pull tab 40, the entire lock pin 60 including the upper elastic member 63 and the lower locking members 62A and 62B moves downward due to an elastic force between the cover 30A and the upper elastic member 63. As a result, the lock pin 60 is in the locked state again.

Figure 15A:
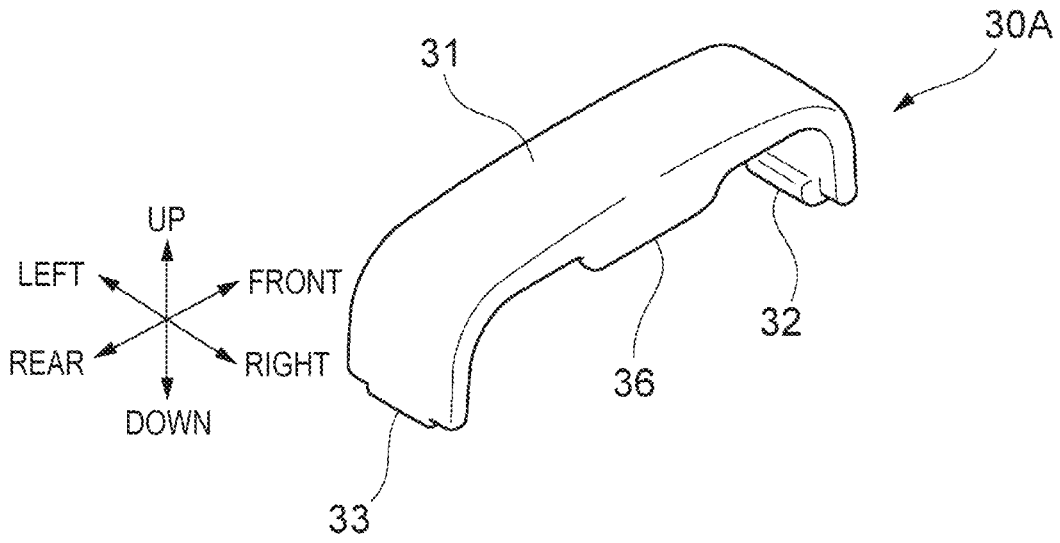
FIG. 15A is a perspective view of a cover.
Figure 15B:
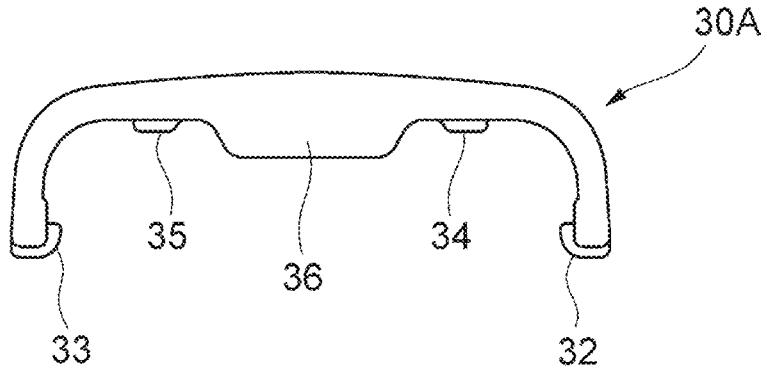
FIG. 15B is a side view of the cover.
Figure 15C:
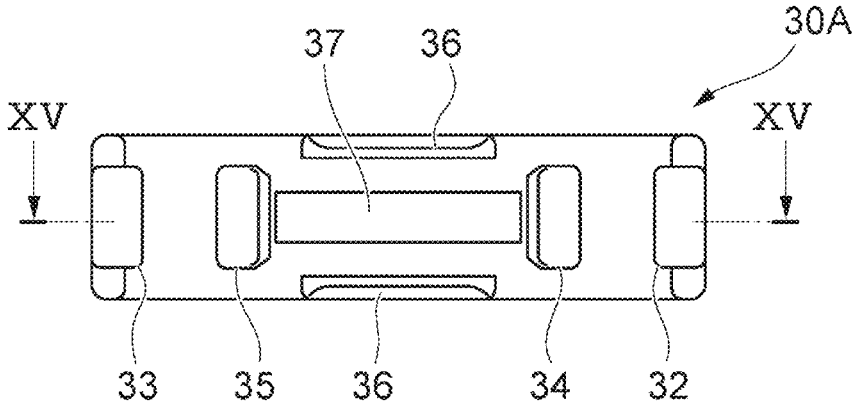
FIG. 15C is a rear view of the cover.
Figure 15D:
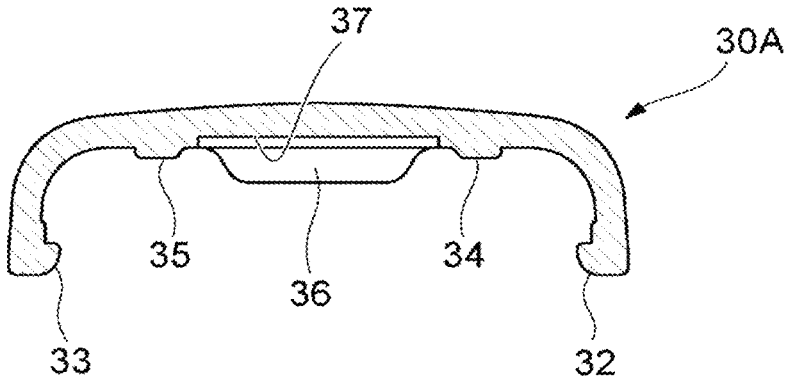
FIG. 15D is a cross-sectional view of the cover illustrated in FIG. 15C taken along a line XV-XV.

FIG. 15A is a perspective view of the cover 30A, FIG. 15B is a side view of the cover 30A, FIG. 15C is a rear view of the cover 30A, and FIG. 15D is a cross-sectional view of the cover 30A illustrated in FIG. 15C taken along a line XV-XV.

As illustrated in FIGS. 15A and 15B, two tab-shaped protruding portions 36 are formed on the cover 30A on both sides in the left and right direction in a central portion of the main body 31 in the front and rear direction. As illustrated in FIGS. 15C and 15D, a recess portion 37 extending in the front and rear direction is formed in a central portion of the back side of the main body 31.

The protruding portions 36 face or come into contact with side surfaces of the two lower locking members 62A and 62B illustrated in FIG. 13 so as to prevent further deformation of the lower locking members 62A and 62B, specifically, prevent outward deformation in the left and right direction. Accordingly, the protruding portion 36 prevents the lower locking members 62A, 62B from losing an elastic force due to excessive deformation.

Further, the recess portion 37 formed on the back side of the cover 30A has a flat inner surface, and stably supports the tip end portion 66 such that the tip end portion 66 can freely slide when the tip end portion 66 of the upper elastic member 63 enters the recess portion 37, thereby preventing the lock pin 60 from unnecessarily shifting.

<Assembly Steps of Slider>

Next, assembly steps of the slider 200 will be described.

FIGS. 16A to 16E are step diagrams each illustrating the assembly steps of the slider 200 in stages. Each assembling operation is performed by an appropriate automatic assembling apparatus.

Figure 16A:
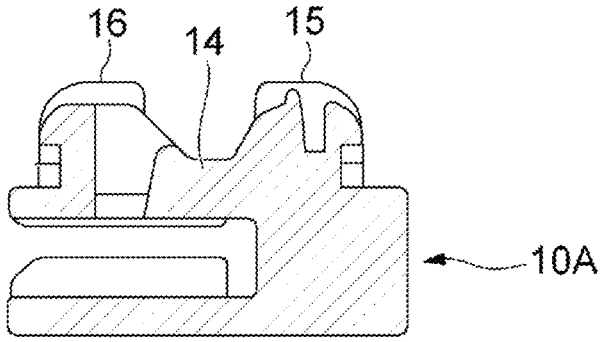
FIG. 16A is a step diagram illustrating assembly steps of the slider in stages.
Figure 16B:
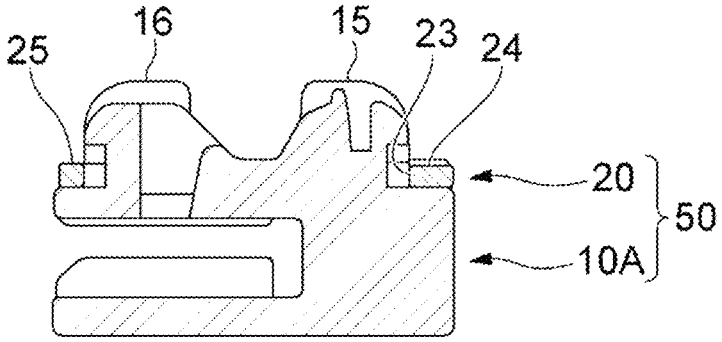
FIG. 16B is a step diagram illustrating the assembly steps of the slider in stages.

As illustrated in FIG. 16A, the lower member 10A is prepared (a first step). Next, as illustrated in FIG. 16B, the upper member 20 is placed on the lower member 10A to form the slider body 50 (a second step). At this time, the upper surface of the upper plate portion 14, the front attachment column 15, and the rear attachment column 16 protrude upward from the opening portion 23. The front placement portion 24 and the rear placement portion 25 are placed on the upper plate portion 14. At this stage, the upper member 20 is only placed on the lower member 10A, and the upper member 20 and the lower member 10A are not engaged with each other.

Figure 16C:
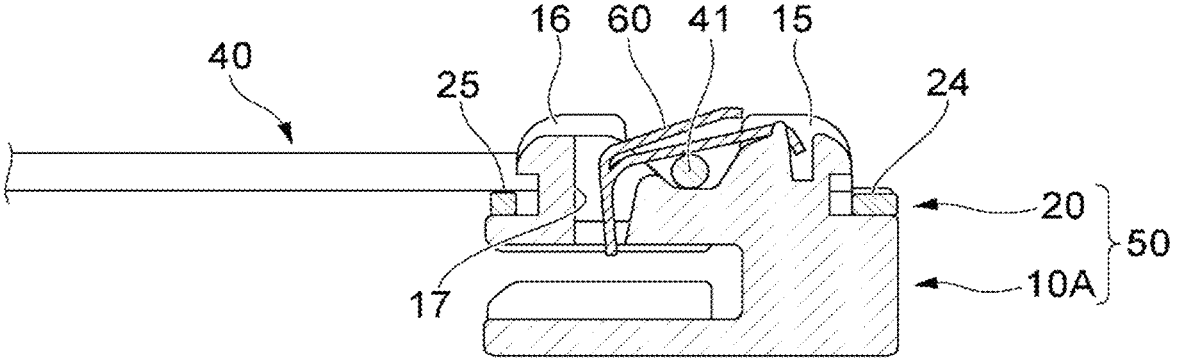
FIG. 16C is a step diagram illustrating the assembly steps of the slider in stages.
Figure 16D:
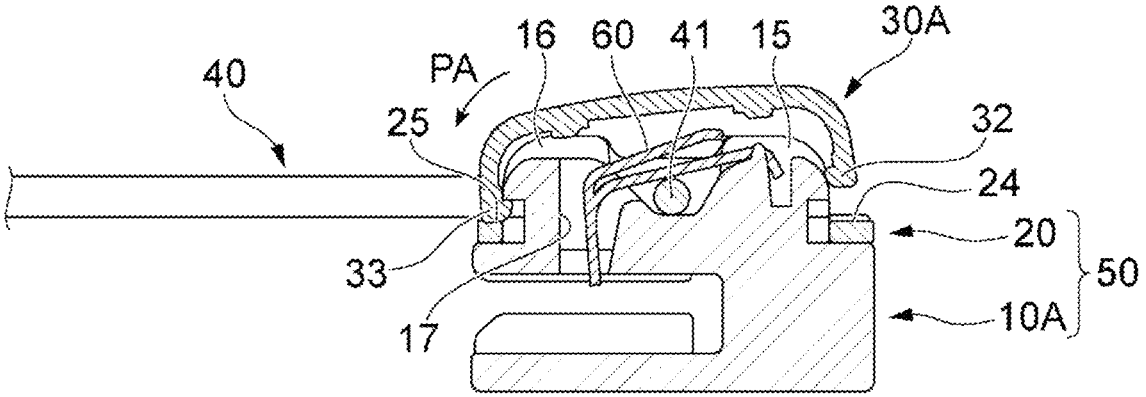
FIG. 16D is a step diagram illustrating the assembly steps of the slider in stages.
Figure 16E:
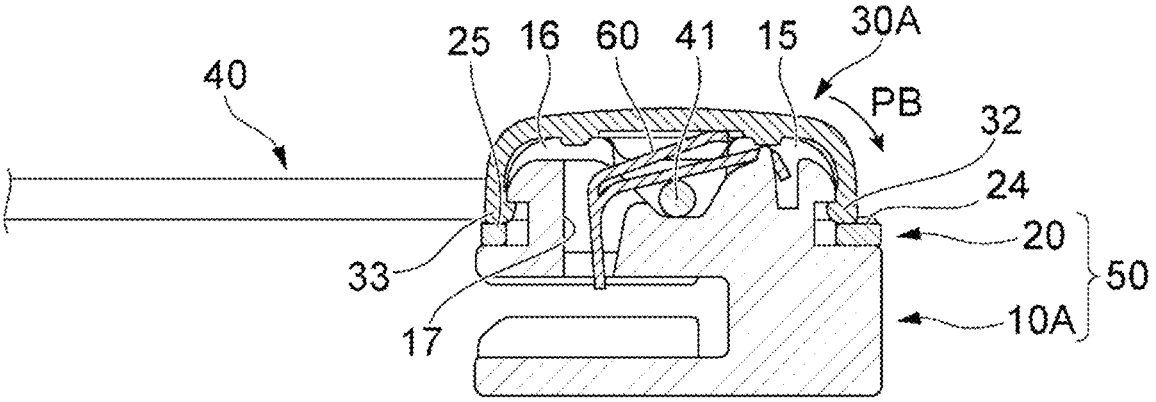
FIG. 16E is a step diagram illustrating the assembly steps of the slider in stages.

Next, as illustrated in FIG. 16C, the shaft portion 41 of the pull tab 40 is temporarily placed in the region between the front attachment column 15 and the rear attachment column 16 on the upper plate portion 14 (a third step). Further, the front locking portion 65 of the lock pin 60 is locked to the front attachment column 15, and the base portion 61 is inserted into the through hole 17. Then, as illustrated in FIGS. 16D and 16E, the cover 30A is attached to the front attachment column 15 and the rear attachment column 16 (a fourth step). Regarding the cover 30A, in order to fix the pull tab 40 first, the rear engaging portion 33 of the cover 30A is first hooked onto the engaged portion 16*a* of the rear attachment column 16 as indicated by an arrow PA in FIG. 16D.

Then, the front engaging portion 32 of the cover 30A is engaged with the engaged portion 15*a* of the front attachment column 15 as indicated by an arrow PB in FIG. 16E. Accordingly, the lower member 10A, the upper member 20, and the cover 30A are integrally assembled in a state in which the pull tab 40 is held between the lower member 10A and the cover 30A, and the assembly of the slider 200 is completed.

In the assembly steps of the slider 200 according to the present embodiment, the respective members are simply stacked upward, and thus the assembly procedure is not complicated, and the assembly steps are suitable for automation. Since the cover 30A is attached after the pull tab 40 is disposed, if the pull tab is accommodated in the space between the cover 30A and the lower member 10A, the pull tab can be easily applied, and various existing pull tabs can be easily used. The pull tab 40 and the cover 30A can be attached by one operation, and the assembly step can be simplified.

As described above, the present invention is not limited to the above embodiments, and the present invention also contemplates mutual combinations of the various components of the embodiments, as well as modifications and applications by those skilled in the art based on the descriptions in the specification and well-known techniques, and the modifications and applications are included in the scope in which protection is required.

For example, in an embodiment to be described above, a case is described in which one slider is attached to the element rows of the fastener chain, but in the present invention, two sliders may be attached to the element rows of the fastener chain such that end portions on a shoulder opening side or end portions on a rear opening side face each other.

Further, the pull tab of the slider is not limited to being disposed on an upper member side of the slider body, and may be attached to a lower member side of the slider body.

As described above, the following matters are disclosed in the present specification.

[1] A slide fastener slider including: a lower member (10); an upper member (20) provided above the lower member (10) so as to face the lower member (10); a cover (30) attached above the upper member (20); and a pull tab (40) held between the upper member and the cover (30), in which the lower member (10) includes a lower blade (11), a guide column (12) provided at a front end portion of the lower blade (11), an upper plate portion (14) connected to the guide column (12) and extending in a front and rear direction so as to face the lower blade (11), and an attachment column (15, 16) provided on the upper plate portion (14), the upper member (20) includes a flat plate portion (21) facing the lower blade (11) and forming an upper blade together with the upper plate portion (14), an opening portion (23) that is formed on the flat plate portion (21) and that allows the attachment column (15, 16) to be inserted therethrough, and a placement portion (24, 25) that is formed in the flat plate portion (21) and that is placed on the upper plate portion (14), the cover (30) includes, at an end portion thereof in the front and rear direction, an engaging portion (32, 33) engaged with an engaged portion (15*a*, 16*a*) provided on the attachment column (15, 16) inserted through the opening portion (23) so as to protrude upward from the flat plate portion (21), a shaft portion (41) provided at one end of the pull tab (40) is disposed in a space formed between the upper plate portion (14) and the cover (30), and the placement portion (24, 25) is sandwiched between the engaging portion (32, 33) of the cover (30) and the upper plate portion (14) by attaching the cover (30) to the attachment column (15, 16) by engaging the engaging portion (32, 33) of the cover (30) with the engaged portion (15*a*, 16*a*) of the attachment column (15, 16).

According to the slide fastener slider, the attachment column of the lower member is inserted through the opening portion of the upper member, and the upper member is placed on the upper plate portion of the lower member. The cover is fixed to the lower member by engaging the upper plate portion, the engaged portion of the attachment column, and the engaging portion of the cover. By fixing the cover, the upper member is sandwiched with the lower member, the pull tab is attached, and the upper member and the pull tab are prevented from coming off.

[2] The slide fastener slider according to [1], in which the upper member (20) is formed with one opening portion (23) extending in the front and rear direction of the flat plate portion (21).

According to the slide fastener slider, when the upper member is assembled to the lower member, the attachment column can be easily inserted through the opening portion.

[3] The slide fastener slider according to [1] or [2], in which the upper member (20) includes a pair of central protrusions (26) protruding from an outer edge of the opening portion (23) toward an inside of the opening portion (23) at an intermediate position of the opening portion (23) in the front and rear direction, and the upper plate portion (14) includes a step portion (14*a*) that allows the central protrusion (26) to be placed.

According to the slide fastener slider, the positioning accuracy of the lower member and the upper member can be improved by engaging the central protrusion with the step portion.

[4] The slide fastener slider according to [1], in which the upper member (20) includes a central placement portion (28) at an intermediate portion of the flat plate portion (21) in the front and rear direction, a front opening portion (23A) is formed in front of the central placement portion (28), and a rear opening portion (23B) is formed in rear of the central placement portion (28).

According to the slide fastener slider, the support area of the upper member is increased, and the posture of the upper member placed on the lower member can be stabilized.

[5] The slide fastener slider according to any one of [1] to [4], in which a lower surface of the upper member (20) is formed with a groove portion (27) that covers the upper plate portion (14) and that extends in the front and rear direction.

According to the slide fastener slider, since the upper plate portion and the groove portion are engaged with each other, the posture of the upper member can be stabilized, and the positioning accuracy of the lower member and the upper member can be improved. In addition, the groove portion can regulate the height of the element guide path, which makes the element rows passing through the element guide path to be favorably meshed with each other.

[6] The slide fastener slider according to any one of [1] to [5], in which the placement portion (24, 25) is recessed from the flat plate portion (21).

According to the slide fastener slider, when the engaging portion of the cover is engaged with the engaged portion of the attachment column, the protruding amount of the cover in the height direction is reduced. This can contribute to downsizing of the slider. Since the placement portion of the upper member is recessed with respect to the surrounding flat plate portion, the engaging portion of the cover is stably positioned on the placement portion.

[7] The slide fastener slider according to any one of [1] to [6], in which the lower member (10) includes a front attachment column (15) provided at a front end portion of the upper plate portion (14), and a rear attachment column (16) provided at a rear end portion of the upper plate portion (14), the engaging portion (32, 33) includes a front engaging portion (32) provided at a front end portion of the cover (30), and a rear engaging portion (33) provided at a rear end portion of the cover (30), the placement portion (24, 25) includes a front placement portion (24) provided at a front end of the flat plate portion (21) and in front of the opening portion, and a rear placement portion (25) provided at a rear end of the flat plate portion (21) and in rear of the opening portion, the front engaging portion (32) of the cover (30) is engaged with the engaged portion (15*a*) of the front attachment column (15) so as to sandwich the front placement portion (24) between the front engaging portion (32) and the upper plate portion (14), and the rear engaging portion (33) of the cover (30) is engaged with the engaged portion (16*a*) of the rear attachment column (16) so as to sandwich the rear placement portion (25) between the rear engaging portion (33) and the upper plate portion (14).

According to the slide fastener slider, the lower member includes the front attachment column and the rear attachment column, and the cover is locked to the front attachment column and the rear attachment column. Accordingly, the upper member is sandwiched between the front attachment column and the rear attachment column, and is fixed more stably.

[8] The slide fastener slider according to [7], further including:

a lock pin (60) of which one end in a longitudinal direction is supported by the front attachment column (15) so as to allow another end in the longitudinal direction to freely move from the upper plate portion (14) toward the lower member (10), in which an intermediate portion between the one end and the other end of the lock pin (60) is disposed in the space, and the shaft portion of the pull tab (40) is disposed between the intermediate portion and the upper plate portion (14).

According to the slide fastener slider, the slider can be prevented from moving with respect to the element rows by the lock pin. When the pull tab is pulled upward, the locked state of the slider achieved by the lock pin is released.

[9] The slide fastener slider according to [8], in which the cover (30) includes a pair of protruding portions (36) protruding toward the upper member (20) on both sides in a width direction orthogonal to the front and rear direction, and the lock pin (60) is disposed inside the pair of protruding portions (36) in the width direction.

According to the slide fastener slider, the protruding portion faces or comes into contact with the side surface of the lock pin so as to prevent further deformation of the lock pin, specifically, prevent outward deformation in the left and right direction. Accordingly, the protruding portion prevents the lock pin from losing an elastic force due to excessive deformation.

REFERENCE SIGNS LIST

10, 10A: lower member
11: lower blade
11*b*: element guide path
12: guide column
13: lower flange portion
14: upper plate portion
14*a*: step portion
14*b*: upper surface
15: front attachment column (attachment column)
15*a*: engaged portion
16: rear attachment column (attachment column)
16*a*: engaged portion
17: through hole
20, 20A: upper member
21: flat plate portion
22: upper flange portion
23: opening portion
23A: front opening portion
23B: rear opening portion
24: front placement portion (placement portion)
25: rear placement portion (placement portion)
26: central protrusion
27: groove portion
28: central placement portion
29: upper blade
30, 30A: cover
31: main body
32: front engaging portion (engaging portion)
32*a*: facing surface
32*b*: tip end
33: rear engaging portion (engaging portion)
33*a*: facing surface
33*b*: tip end
34: front protruding portion
35: rear protruding portion
36: protruding portion
37: recess portion
38: front recess
39: rear recess
40: pull tab
41: shaft portion

50: slider body
60: lock pin
61: base portion
62A, 62B: lower locking member
63: upper elastic member
65: front locking portion
66: tip end portion
100, 200: slider (slide fastener slider)
S: space

The invention claimed is:

1. A slide fastener slider comprising: a lower member; an upper member provided above the lower member so as to face the lower member; a cover attached above the upper member; and a pull tab held between the upper member and the cover, wherein the lower member includes a lower blade, a guide column provided at a front end portion of the lower blade, an upper plate portion connected to the guide column and extending in a front and rear direction so as to face the lower blade, and an attachment column provided on the upper plate portion, the upper member includes a flat plate portion facing the lower blade and forming an upper blade together with the upper plate portion, an opening portion that is formed on the flat plate portion and that allows the attachment column to be inserted therethrough, and a placement portion that is formed in the flat plate portion and that is placed on the upper plate portion, the cover includes, at an end portion thereof in the front and rear direction, an engaging portion engaged with an engaged portion provided on the attachment column inserted through the opening portion so as to protrude upward from the flat plate portion, a shaft portion provided at one end of the pull tab is disposed in a space formed between the upper plate portion and the cover, and the placement portion is sandwiched between the engaging portion of the cover and the upper plate portion by attaching the cover to the attachment column by engaging the engaging portion of the cover with the engaged portion of the attachment column.

2. The slide fastener slider according to claim 1, wherein the upper member is formed with the opening portion extending in the front and rear direction of the flat plate portion.

3. The slide fastener slider according to claim 1, wherein the upper member includes a pair of central protrusions protruding from an outer edge of the opening portion toward an inside of the opening portion at an intermediate position of the opening portion in the front and rear direction, and the upper plate portion includes a pair of step portions that allow the pair of central protrusions to be placed.

4. The slide fastener slider according to claim 1, wherein the upper member includes a central placement portion at an intermediate portion of the flat plate portion in the front and rear direction, a front opening portion is formed in front of the central placement portion, and a rear opening portion is formed in rear of the central placement portion.

5. The slide fastener slider according to claim 1, wherein a lower surface of the upper member is formed with a groove portion that covers the upper plate portion and that extends in the front and rear direction.

6. The slide fastener slider according claim 1, wherein the placement portion is recessed from the flat plate portion.

7. The slide fastener slider according to claim 1, wherein the lower member includes a front attachment column provided at a front end portion of the upper plate portion, and a rear attachment column provided at a rear end portion of the upper plate portion, the engaging portion includes a front engaging portion provided at a front end portion of the cover, and a rear engaging portion provided at a rear end portion of the cover, the placement portion includes a front placement portion provided at a front end of the flat plate portion and in front of the opening portion, and a rear placement portion provided at a rear end of the flat plate portion and in rear of the opening portion, the front engaging portion of the cover is engaged with the engaged portion of the front attachment column-so as to sandwich the front placement portion between the front engaging portion and the upper plate portion, and the rear engaging portion of the cover is engaged with the engaged portion of the rear attachment column so as to sandwich the rear placement portion between the rear engaging portion and the upper plate portion.

8. The slide fastener slider according to claim 7, further comprising:

a lock pin of which one end in a longitudinal direction is supported by the front attachment column so as to allow another end in the longitudinal direction to freely move from the upper plate portion toward the lower member, wherein an intermediate portion between the one end and the another end of the lock pin is disposed in the space, and the shaft portion of the pull tab is disposed between the intermediate portion and the upper plate portion.

9. The slide fastener slider according to claim 8, wherein the cover includes a pair of protruding portions-protruding toward the upper member on both sides in a width direction orthogonal to the front and rear direction, and the lock pin is disposed inside the pair of protruding portions in the width direction.

* * * * *